US010598000B2

(12) United States Patent
Liu et al.

(10) Patent No.: US 10,598,000 B2
(45) **Date of Patent: *Mar. 24, 2020**

(54) METHODS AND APPARATUS FOR DOWNHOLE PROBES

(71) Applicant: EVOLUTION ENGINEERING INC., Calgary (CA)

(72) Inventors: Jili (Jerry) Liu, Calgary (CA); Patrick R. Derkacz, Calgary (CA); Aaron W. Logan, Calgary (CA); Justin C. Logan, Calgary (CA); David A. Switzer, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 15/906,855

(22) Filed: Feb. 27, 2018

(65) Prior Publication Data

US 2018/0202282 A1 Jul. 19, 2018

Related U.S. Application Data

(63) Continuation of application No. 14/650,502, filed as application No. PCT/CA2012/050885 on Dec. 7, 2012, now Pat. No. 9,951,603.

(51) Int. Cl.

| | |
|---|---|
| ***E21B 17/16*** | (2006.01) |
| ***E21B 47/01*** | (2012.01) |
| ***E21B 17/10*** | (2006.01) |

(52) U.S. Cl.

CPC ..... *E21B 47/01* (2013.01); *E21B 17/1007* (2013.01); *E21B 17/1078* (2013.01); *E21B 17/16* (2013.01); *E21B 47/011* (2013.01)

(58) Field of Classification Search

CPC ..... E21B 17/01; E21B 17/16; E21B 47/01; E21B 47/011

See application file for complete search history.

(56) References Cited

U.S. PATENT DOCUMENTS

| | | | |
|---|---|---|---|
| 3,323,327 | A | 6/1967 | Leathers et al. |
| 3,982,431 | A | 9/1976 | Grosso et al. |
| 4,013,945 | A | 3/1977 | Grosso |
| 4,021,774 | A | 5/1977 | Asmundsson et al. |
| 4,216,536 | A | 8/1980 | More |
| 4,351,116 | A | 9/1982 | Scott, Jr. |
| 4,468,762 | A | 8/1984 | Jurgens |

(Continued)

FOREIGN PATENT DOCUMENTS

| | | | |
|---|---|---|---|
| CA | 2462987 | A1 | 9/2004 |
| CA | 2735619 | A1 | 9/2012 |

(Continued)

OTHER PUBLICATIONS

National Oilwell Varco Blackstar EMWD brochure, Apr. 23, 2007.

*Primary Examiner* — Cathleen R Hutchins

(74) *Attorney, Agent, or Firm* — Oyen Wiggs Green & Mutala LLP

(57) ABSTRACT

A method for using a downhole probe. The method comprises providing a probe, at least one vertical cross section of the probe having an area of at least pi inches squared. The method further comprises inserting the probe into a bore of a drill collar and passing a drilling fluid through the bore of drill collar at a flow velocity of less than 41 feet per second.

34 Claims, 14 Drawing Sheets

(56) References Cited

U.S. PATENT DOCUMENTS

| | | | | |
|---|---|---|---|---|
| 4,537,067 | A * | 8/1985 | Sharp | E21B 47/022 374/136 |
| 4,571,215 | A | 2/1986 | Hansen | |
| 4,684,946 | A | 8/1987 | Issenmann | |
| 4,734,893 | A | 3/1988 | Claycomb | |
| 4,862,425 | A | 8/1989 | Cretin et al. | |
| 4,901,289 | A | 2/1990 | Cretin et al. | |
| 4,938,299 | A | 7/1990 | Jelsma | |
| 5,064,006 | A | 11/1991 | Waters et al. | |
| 5,160,925 | A | 11/1992 | Dailey et al. | |
| 5,236,048 | A | 8/1993 | Skinner et al. | |
| 5,247,990 | A | 9/1993 | Sudol et al. | |
| 5,294,923 | A | 3/1994 | Juergens et al. | |
| 5,333,686 | A | 8/1994 | Vaughan et al. | |
| 5,396,966 | A | 3/1995 | Roos, Jr. et al. | |
| 5,474,132 | A | 12/1995 | Gallagher | |
| 5,520,246 | A | 5/1996 | Van Steenwyk et al. | |
| 5,590,714 | A | 1/1997 | Van Steenwyk et al. | |
| 5,795,991 | A | 8/1998 | Hesse et al. | |
| 6,009,216 | A | 12/1999 | Pruett et al. | |
| 6,429,653 | B1 | 8/2002 | Kruspe et al. | |
| 6,446,736 | B1 | 9/2002 | Kruspe et al. | |
| 6,470,979 | B1 | 10/2002 | Wentworth et al. | |
| 6,578,631 | B2 | 6/2003 | Milne et al. | |
| 6,750,783 | B2 | 6/2004 | Rodney | |
| 7,151,466 | B2 | 12/2006 | Gabelmann et al. | |
| 7,243,028 | B2 | 7/2007 | Young et al. | |
| 8,201,645 | B2 | 6/2012 | Hall et al. | |
| 8,251,160 | B2 | 8/2012 | Gopalan et al. | |
| 8,284,073 | B2 | 10/2012 | Mehta et al. | |
| 8,474,548 | B1 | 7/2013 | Young et al. | |
| 2003/0056984 | A1* | 3/2003 | Smith | E21B 47/011 175/40 |
| 2005/0217898 | A1 | 10/2005 | Clark | |
| 2006/0202852 | A1 | 9/2006 | Peter et al. | |
| 2007/0074908 | A1 | 4/2007 | Litter et al. | |
| 2007/0227780 | A1* | 10/2007 | MacPherson | E21B 21/08 175/320 |
| 2007/0235224 | A1* | 10/2007 | Koger | E21B 17/1007 175/40 |
| 2008/0245570 | A1 | 10/2008 | Partouche | |
| 2009/0023502 | A1 | 1/2009 | Koger | |
| 2009/0267790 | A1 | 10/2009 | Hall et al. | |
| 2013/0133882 | A1 | 5/2013 | Harms et al. | |
| 2014/0124269 | A1* | 5/2014 | Logan | E21B 47/011 175/325.1 |
| 2014/0246234 | A1* | 9/2014 | Gillis | E21B 7/24 175/24 |

FOREIGN PATENT DOCUMENTS

| | | | |
|---|---|---|---|
| WO | 0047869 | A1 | 8/2000 |
| WO | 2006083764 | A1 | 8/2008 |
| WO | 2008116077 | A2 | 9/2008 |
| WO | 2009048768 | A2 | 4/2009 |
| WO | 2010104716 | A1 | 9/2010 |
| WO | 2012045698 | A1 | 4/2012 |
| WO | 2012082748 | A2 | 6/2012 |

* cited by examiner

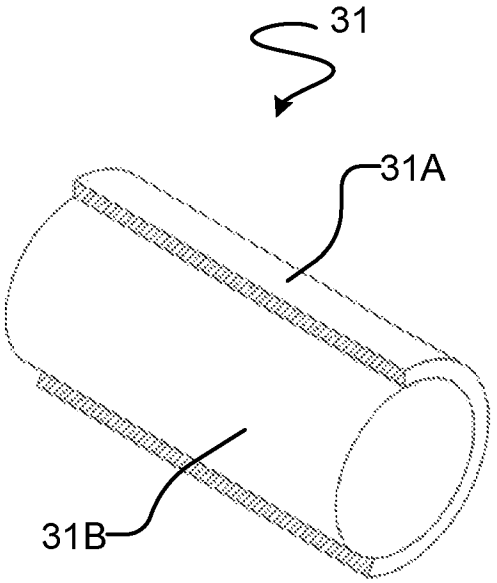
FIG. 3A
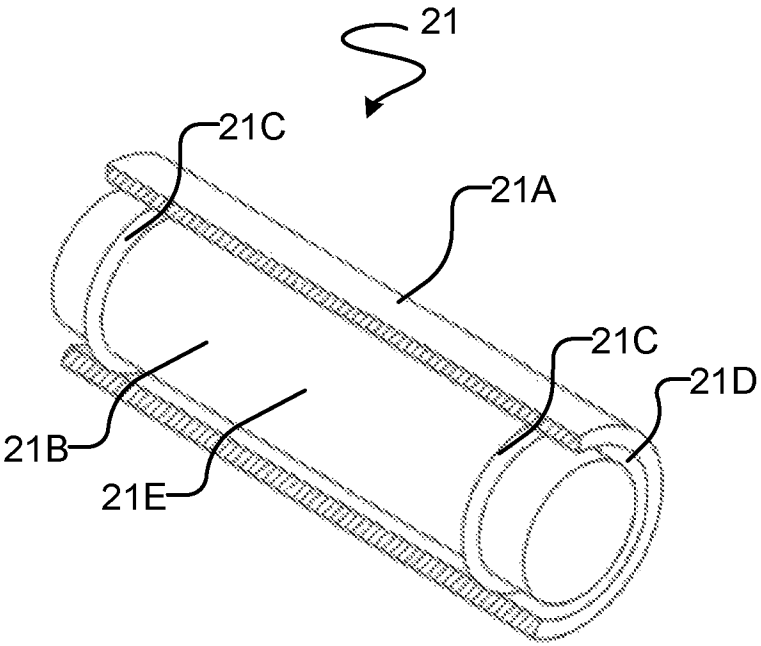
FIG. 2A – Prior Art

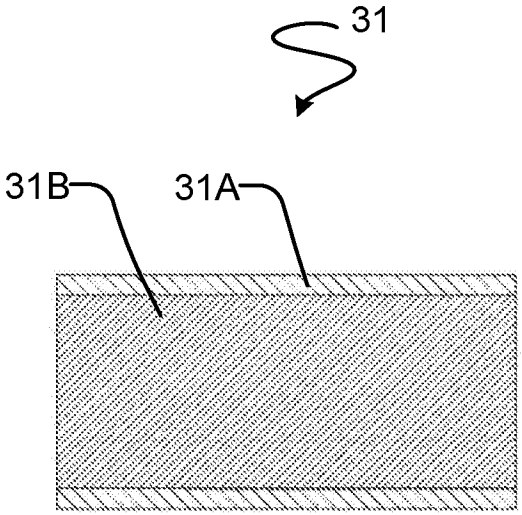
FIG. 3B
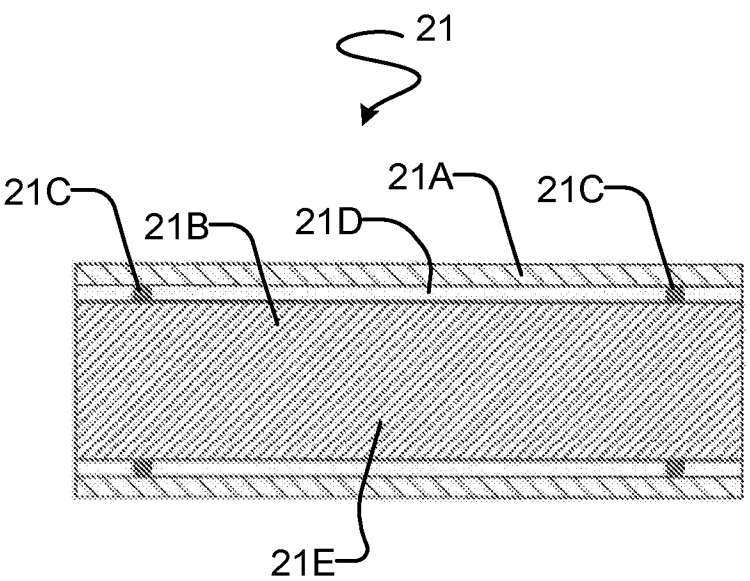
FIG. 2B – Prior Art

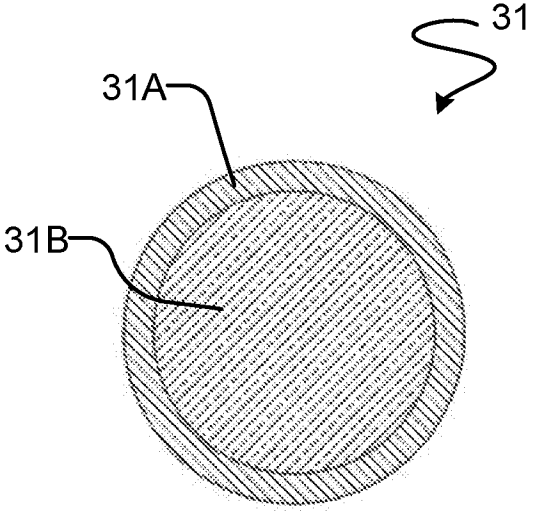
FIG. 3C
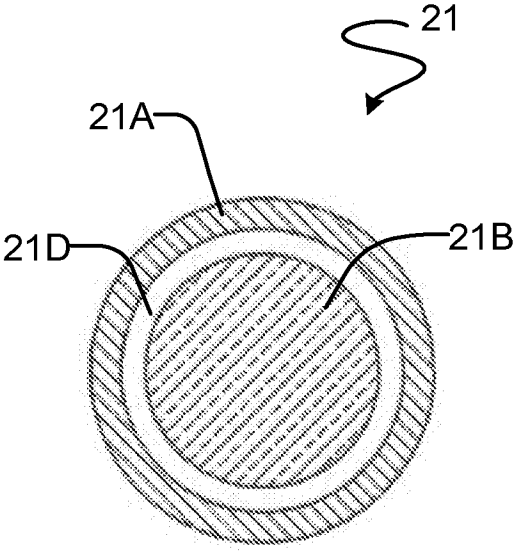
FIG. 2C – Prior Art

METHODS AND APPARATUS FOR DOWNHOLE PROBES

CROSS REFERENCE TO RELATED APPLICATIONS

This application is a continuation of U.S. application Ser. No. 14/650,502, which is a 371 of PCT Application No. PCT/CA2012/050885 filed 7 Dec. 2012.

TECHNICAL FIELD

This invention relates to subsurface drilling, specifically to drilling operations that use downhole probes. Embodiments are applicable to drilling wells for recovering hydrocarbons.

BACKGROUND

Recovering hydrocarbons from subterranean zones relies on drilling wellbores.

Wellbores are made using surface-located drilling equipment which drives a drill string that eventually extends from the surface equipment to the formation or subterranean zone of interest. The drill string can extend thousands of feet or meters below the surface. The terminal end of the drill string includes a drill bit for drilling (or extending) the wellbore. Drilling fluid usually in the form of a drilling "mud" is typically pumped through the drill string. The drilling fluid cools and lubricates the drill bit and also carries cuttings back to the surface. Drilling fluid may also be used to help control bottom hole pressure to inhibit hydrocarbon influx from the formation into the wellbore and potential blow out at surface.

Bottom hole assembly (BHA) is the name given to the equipment at the terminal end of a drill string. In addition to a drill bit a BHA may comprise elements such as: apparatus for steering the direction of the drilling (e.g. a steerable downhole mud motor or rotary steerable system); one or more downhole probes, stabilizers; heavy weight drill collars, pulsers and the like. The BHA is typically advanced into the wellbore by a string of metallic tubulars (drill pipe).

A downhole probe may comprise any active mechanical, electronic, and/or electromechanical system that operates downhole. A probe may provide any of a wide range of functions including, without limitation, data acquisition, measuring properties of the surrounding geological formations (e.g. well logging), measuring downhole conditions as drilling progresses, controlling downhole equipment, monitoring status of downhole equipment, measuring properties of downhole fluids and the like. A probe may comprise one or more systems for: telemetry of data to the surface; collecting data by way of sensors (e.g. sensors for use in well logging) that may include one or more of vibration sensors, magnetometers, inclinometers, accelerometers, nuclear particle detectors, electromagnetic detectors, acoustic detectors, and others; acquiring images; measuring fluid flow; determining directions; emitting signals, particles or fields for detection by other devices; interfacing to other downhole equipment; sampling downhole fluids; etc. Some downhole probes are highly specialized and expensive.

Downhole conditions can be harsh. Exposure to these harsh conditions, which can include high temperatures, vibrations (including axial, lateral, and torsional vibrations), turbulence and pulsations in the flow of drilling fluid past the probe, shocks, and immersion in various drilling fluids at high pressures can shorten the lifespan of downhole probes and increase the probability that a downhole probe will fail in use. Supporting and protecting downhole probes is important as a downhole probe may be subjected to high pressures (20,000 p.s.i. [138 $MN/m^2$] or more in some cases), along with severe shocks and vibrations. Furthermore, replacing a downhole probe that fails while drilling can involve very great expense.

There are references that describe various centralizers that may be useful for supporting a downhole electronics package centrally in a bore within a drill string. The following is a list of some such references: US2007/0235224; US2005/0217898; U.S. Pat. No. 6,429,653; U.S. Pat. No. 3,323,327; U.S. Pat. No. 4,571,215; U.S. Pat. No. 4,684,946; U.S. Pat. No. 4,938,299; U.S. Pat. No. 5,236,048; U.S. Pat. No. 5,247,990; U.S. Pat. No. 5,474,132; U.S. Pat. No. 5,520,246; U.S. Pat. No. 6,429,653; U.S. Pat. No. 6,446,736; U.S. Pat. No. 6,750,783; U.S. Pat. No. 7,151,466; U.S. Pat. No. 7,243,028; US2009/0023502; WO2006/083764; WO2008/116077; WO2012/045698; and WO2012/082748.

CA2735619 discloses snubber shock assemblies for measuring while drilling components that have natural frequencies that are less than a vibration frequency of an agitator.

U.S. Pat. No. 5,520,246 issued May 28, 1996 discloses apparatus for protecting instrumentation placed within a drill string. The apparatus includes multiple elastomeric pads spaced about a longitudinal axis and protruding in directions radially to the axis. The pads are secured by fasteners.

US 2005/0217898 published Oct. 6, 2005 describes a drill collar for dampening downhole vibration in the tool-housing region of a drill string. The collar has a hollow cylindrical sleeve having a longitudinal axis and an inner surface facing the longitudinal axis. Multiple elongate ribs are mounted to the inner surface and extend parallel to the longitudinal axis.

There remains a need for better ways to provide downhole probes at downhole locations in a way that provides enhanced resistance to damage from mechanical shocks and vibrations and other downhole conditions.

SUMMARY

The invention has a number of aspects. One aspect of the invention provides a method for using a downhole probe. The method comprises providing a probe, at least one cross section of the probe having an area of at least pi inches squared (approximately 20 $cm^2$). The method further comprises inserting the probe into a bore of a drill collar and passing a drilling fluid through the bore of drill collar at a flow velocity of less than 41 feet per second (about 12½ m/s).

In some embodiments, at least one cross section of the probe has an area of at least 3 inches squared (19 $cm^2$) (at least 3½ inches squared [23 $cm^2$] in some embodiments). In some embodiments of the invention the probe is cylindrical and has an outside diameter of 2.54 inches (6 cm) and a total cross-sectional area of 5 inches squared (32 $cm^2$) (such a probe may, for example have a housing with an inside diameter of 2 inches [5 cm]). In some embodiments such probes are deployed in non-standard drill collars having standard outside diameters and non-standard extra large inside diameters such that a desired area is maintained for the flow of drilling fluid.

In some embodiments, the method comprises providing a probe comprising an electronics unit and a housing, and inserting the electronics unit into the housing such that at least a portion of the electronics unit forms a size-on-size fit with the housing. In some embodiments the entire length of the electronics unit forms a size-on-size fit with the housing.

In some embodiments the electronics unit comprises a tubular sleeve containing electronics. The electronics may be potted within the sleeve. An outer surface of the sleeve may be formed to have the desired size-on-size fit in the housing.

In some embodiments, the electronics unit is shaped like a cylinder and the housing is shaped like a hollow cylinder and the exterior diameter of the electronics unit is substantially equal to the interior diameter of the housing so that there is virtually no clearance for the electronics unit to move so as to bang against the housing and yet the electronics unit can still be slid into and out of the housing. In some embodiments the electronics unit and housing are dimensioned so as to provide a running fit between the electronics unit and the housing.

In some embodiments, the entire longitudinal surface of the electronics unit is dimensioned to form a size-on-size fit with the housing.

In some embodiments, the size-on-size fit prevents the electronics unit from moving laterally relative to the housing.

In some embodiments, a thin material is provided between an exterior lateral wall of the electronics unit and an interior lateral wall of the housing. In some embodiments there are no objects between the exterior lateral wall of the electronics unit and the interior lateral wall of the housing.

In some embodiments, the housing has a length to outer diameter ratio of 60:1. In some embodiments the housing is less than 20 feet (6 m) or 13 feet long (4 m).

In some embodiments, the method comprises mechanically coupling the housing to the collar. The mechanical coupling may couple rotationally (torsionally) or radially (laterally) and preferably couples the housing to the collar both radially and rotationally. The probe may be supported along all or substantially all of the full length of the housing in some embodiments.

In some embodiments, the method comprises providing a centralizer, inserting the electronics package into the centralizer, and inserting the centralizer into the bore of the collar.

In some embodiments, the centralizer comprises an elongated tubular member having a wall formed to provide a cross section that provides first outwardly-convex and inwardly-concave lobes, the first lobes arranged to contact an internal wall of the collar at a plurality of spots spaced apart around an internal circumference of the collar; and a plurality of inwardly-projecting portions, each of the plurality of inwardly-projecting portions arranged between two adjacent ones of the plurality of first lobes.

In some embodiments the centralizer comprises a tubular member having a wall extending around the probe, the wall formed to contact an internal wall of the collar and an outside surface of the housing, a cross section of the wall following a path around the probe that zig zags back and forth between the outside surface of the housing and the internal wall of the collar.

Another aspect of the invention provides downhole probes.

Another aspect of the invention provides downhole assemblies configured for supporting downhole probes. The downhole assemblies may include downhole probes.

Further aspects of the invention and features of example embodiments are illustrated in the accompanying drawings and/or described in the following description.

BRIEF DESCRIPTION OF THE DRAWINGS

The accompanying drawings illustrate non-limiting example embodiments of the invention.

FIG. 2A is a schematic view of a probe known in the prior art. FIGS. 2B and 2C are respectively longitudinal and vertical cross sections of the probe in FIG. 2A.

FIG. 3A is a schematic view of a probe according to one embodiment of the invention. FIGS. 3B and 3C are respectively longitudinal and vertical cross sections of the probe in FIG. 3A.

DESCRIPTION

Figure 1:
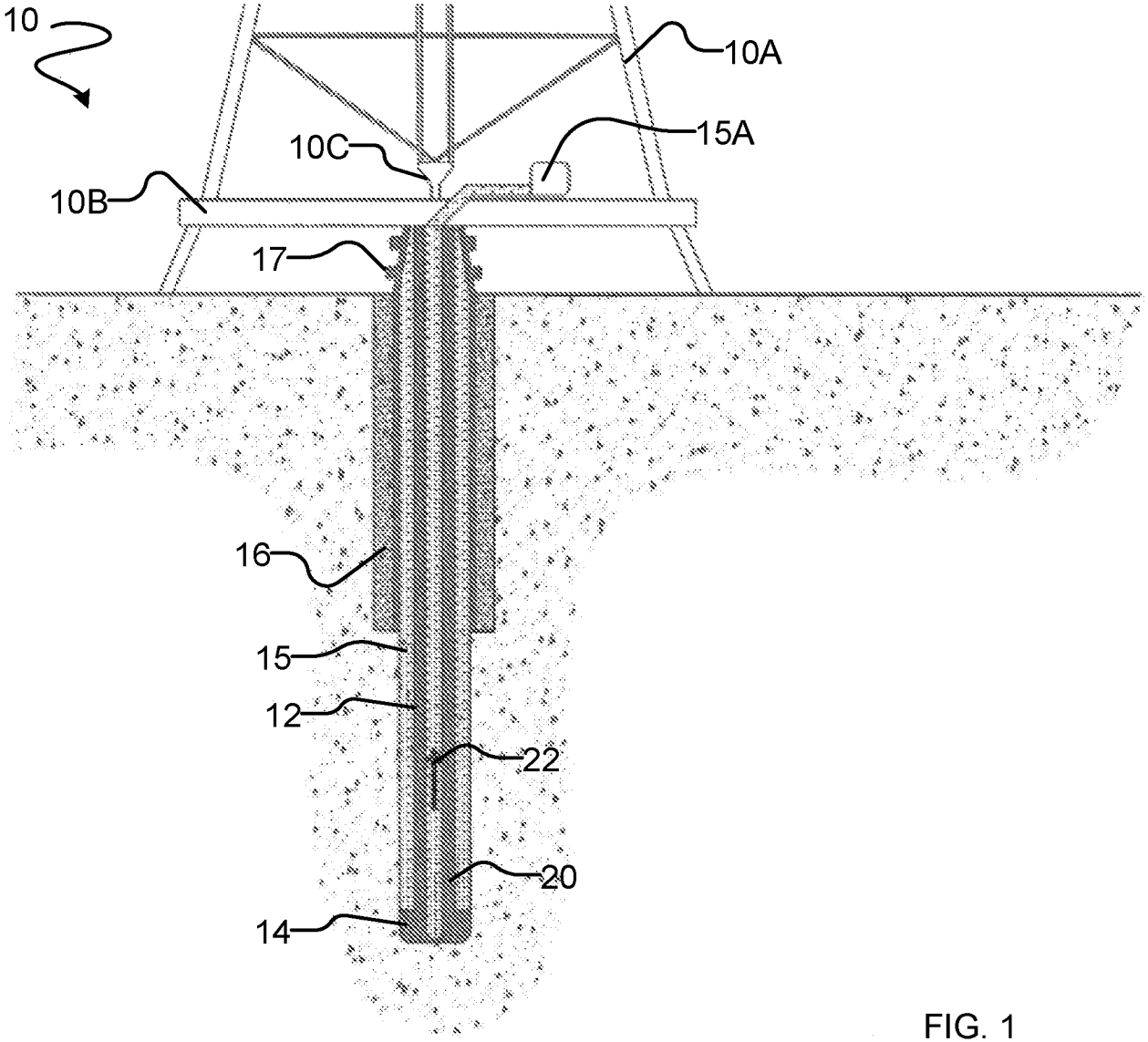
FIG. 1 is a schematic view of a drilling operation according to one embodiment of the invention.

FIG. 1 shows schematically an example drilling operation. A drill rig 10 drives a drill string 12 which includes sections of drill pipe that extend to a drill bit 14. The illustrated drill rig 10 includes a derrick 10A, a rig floor 10B and draw works 100 for supporting the drill string. Drill bit 14 is larger in diameter than the drill string above the drill bit. An annular region 15 surrounding the drill string is typically filled with drilling fluid. The drilling fluid is pumped by a pump 15A through a bore in the drill string to the drill bit and returns to the surface through annular region 15 carrying cuttings from the drilling operation. As the well is drilled, a casing 16 may be made in the well bore. A blow out preventer 17 is supported at a top end of the casing. The drill rig illustrated in FIG. 1 is an example only. The methods and apparatus described herein are not specific to any particular type of drill rig.

Drill string 12 includes a downhole probe 22. Probe 22 may comprise any sort of downhole probe, some examples of which are described above. Drill string 12 may contain more than one downhole probe 22.

Damage to a downhole probe is especially likely when a resonant vibrational mode of the downhole probe is excited. External vibrations at or near the frequency of a vibrational mode of a downhole probe can cause the probe to experience large amplitude resonant vibrations. These vibrations may be severe enough to break internal components of the probe and/or cause the probe to impact against adjacent surfaces and/or to weaken components of the probe. The present invention provides several features that may be beneficially combined in a downhole probe system but also have application individually and in sub-combinations. These features can be applied to make downhole probes more tolerant of downhole conditions and less prone to failure.

As noted above, the downhole environment is very challenging to mechanical structures. Interaction between the rotating drill bit and the formation being drilled into results in significant vibration. Since the drill bit is typically significantly larger in diameter than the drill string sections uphole from the drill bit the drill string sections can move, sometimes with significant accelerations from side-to side within the bore hole. Flowing drilling fluid is an additional source of vibrations. Variations in the flow and turbulence in the flow can apply significant mechanical forces to downhole probes. The frequency spectrum of downhole vibrations tends to be dominated by low-frequency vibrations. For example, rotation of a drill bit at 300 RPM (5 Hz) may lead to a vibration frequency spectrum having a peak at about 5 Hz that drops off fairly significantly at higher frequencies. In most drilling situations drill bits are rotated at speeds slower than 300 RPM. Rotation of drill bits at lower rates of revolution (e.g. 120 RPM to 200 RPM) may lead to a frequency spectrum of downhole vibration that peaks at still lower frequencies (e.g. 2 Hz to 3.33 Hz) and drops off significantly at higher frequencies.

The inventors have noted that accelerations of components within a downhole probe can be magnified significantly if the downhole probe has a vibration mode that coincides with a frequency of the vibration to which the downhole probe is exposed such that the downhole probe (or a part thereof) undergoes resonant vibration. Acceleration of the downhole probe and its components can be magnified further still if the downhole probe is caused to move in such a manner that it bangs into another structure (e.g. a wall of a drill collar). Such banging is particularly bad where a hard surface of the downhole probe impacts against another hard surface. Such impacts can cause 'pinging' (high amplitude, high frequency vibrations) that can be very damaging to electronics, wiring, and other sensitive devices.

Various previous devices have attempted to address the general problem that large accelerations can be damaging to downhole probes, especially when repeated. Since it is given that drill string sections will be subjected to large accelerations when used under typical downhole conditions some prior art devices have attempted through the use of various mechanisms to isolate downhole probes from vibration by providing rubber or similar cushioning elements between the downhole probe and the drill string sections through which the downhole probe passes. The present inventors have determined that such cushioning/isolation can be counterproductive because allowing the downhole probe to move with respect to the drill string sections to reduce transmission of vibrations to the downhole probe often makes the downhole probe susceptible to experiencing even more damaging motions resulting from excitation of resonant modes of the downhole probe and impacts between the downhole probe and other structures.

Described herein are a number of constructions that are advantageously applied in combination with one another but can also be used individually or in sub-combinations with one another or with other known apparatus. In some embodiments a downhole probe is mechanically tightly coupled to one or more drill string sections through which it extends. While such coupling does expose the downhole probe to the vibration of the drill string sections the coupling can raise the resonant frequency of the downhole probe sufficiently to make such vibrations less damaging than they would otherwise be. This can be achieved while maintaining the downhole probe centered in the drill string which is convenient for certain types of measurements.

In some embodiments the downhole probe is increased in diameter relative to prior comparable downhole probes. Such increased diameter also tends to increase the stiffness of the downhole probe and to increase the frequencies of vibrational modes of the downhole probe. Use of a downhole probe having an increased diameter in a drill string made of standard drill collars while maintaining sufficient passage for drilling fluid would be impossible for at least some sizes of drill collar. In some embodiments, the use of such larger-diameter downhole probes is facilitated through the use of non-standard drill collars having standard outside diameters but increased bore diameters. Such non-standard drill collars may be made of high strength materials so that they provide strength equivalent to that of the standard drill collars they replace.

Increasing the diameter of a downhole probe can provide increased internal volume. This, in turn facilitates packing more electronics or other components into each length of the downhole probe. Consequently the downhole probe may be made shorter than comparable prior art probes. This length reduction is compounded by the fact that downhole probes are typically made up of a number of sections coupled together by couplings. The active components housed in such probes are divided among the sections. Typically each added coupling necessitates wire harnesses and associated electrical couplings to carry electrical power and signals between the sections as well as added mechanical parts to support the active components. Each coupling typically has a significant length that is not available for electronics or other components. Packing more functionality into each length of the probe reduces the number of sections needed to provide functionality which, in turn, reduces the number of couplings needed, which, in turn reduces the overall length of the probe. The reduced length, in turn, tends to increase the frequency of vibrational modes of the probe.

In some embodiments the probe is internally constructed such that there is a size-on size fit between internal components of the probe and a housing of the probe. Such construction couples the internal components to move with the probe and can improve reliability.

Features as described herein relate to the following aspects of probe systems: internal construction of probes; probe form factors; drill collar dimensions and construction; and mounting of probes within the drill string.

Downhole probes are generally supported within the bore of one or more drill collars. Probes are typically long and thin so that they can fit within the bores of standard API drill collars while leaving enough room for drilling fluid to flow around the probe. The cross-sectional area made available for the flow of drilling fluid around the probe should also be large enough that the velocity of drilling fluid flowing past the probe is not excessive. Excessive flow velocities can lead to cavitation which can damage both the probe and the drill collars in which the probe is mounted. It is generally accepted that the flow velocity of drilling fluid should be maintained below 41 feet/sec (about 12½ m/s).

TABLE I

Some Example Drill Collar Dimensions According to API Specification 7/7-1.

| Collar OD (inches) | | Collar ID (inches) | |
|---|---|---|---|
| 3⅛ | 8 | 1¼ | 3 |
| 3⅛ | 9 | 1½ | 4 |
| 4⅛ | 10 | 2 | 5 |
| 4¾ | 12 | 2¼ | 6 |
| 5 | 13 | 2¼ | 6 |
| 6 | 15 | 2¼ | 6 |
| 6 | 15 | 2⅛ | 7 |
| 6¼ | 16 | 2¼ | 6 |
| 6¼ | 16 | 2 13/16 | 7 |
| 6½ | 17 | 2¼ | 6 |
| 6½ | 17 | 2 13/16 | 7 |
| 6¾ | 17 | 2¼ | 6 |
| 7 | 18 | 2¼ | 6 |
| 7 | 18 | 2 13/16 | 7 |
| 7¼ | 18 | 2 13/16 | 7 |
| 8 | 20 | 2 13/16 | 7 |
| 8 | 20 | 3 | 8 |
| 8¼ | 21 | 2 13/16 | 7 |
| 9½ | 24 | 3 | 8 |
| 9¾ | 25 | 3 | 8 |
| 10 | 25 | 3 | 8 |
| 11 | 28 | 3 | 8 |

Drill collars may be drilled to increase the internal bore diameter. However, increasing the internal diameter more than a small amount would result in the drill collar being excessively weakened and unsuitable for use. For example, a standard 4¾ (12 cm) drill collar can be bored out from 2¼ to 2 11/16 inches (6 cm to 7 cm); a standard 8 inch (20 cm) OD drill collar can be bored out from 3 inches to 3¼ inches (7.6 cm to 8.3 cm).

A downhole probe 22 typically comprises a protective housing. A probe housing may comprise a hollow cylindrical tube with closed ends. Active components of the probe (e.g. batteries, sensors, electronics, telemetry signal generators, etc.) are housed in a chamber within the probe housing. A probe housing may be made of any suitable material. Two examples of materials suitable for use as a probe housing are suitable stainless steels and beryllium copper.

FIG. 2A shows schematically a probe 21 comprising a housing 21A and an electronics unit 21B supported within housing 21A. Electronics unit 21B comprises a support structure which carries electronics components. Electronics unit 21B is smaller in diameter than an inner diameter of housing 21A. Shock rings 21C are spaced apart along electronics unit 21B. Shock rings 21C extend around electronics unit 21B and bear against the inner wall of probe housing 21A. Shock rings 21C maintain a gap 21D between electronics unit 21B and the inner wall of probe housing 21A. FIGS. 2B and 2C are respectively longitudinal and vertical cross sections of downhole probe 21.

It is widely accepted in the industry that a probe construction that includes shock rings 21C is necessary to protect electronics unit 21B from vibrations and shocks in the downhole environment.

FIG. 3A shows schematically a downhole probe 31 according to an example embodiment. Probe 31 comprises a probe housing 31A and an electronics unit 31B supported within housing 31A. In contrast to prior art probe 21, electronics unit 31B of downhole probe 31 has an outer diameter which is substantially equal to the inner diameter of housing 31A. Thus electronics unit 31B and probe housing 31A have a "size-on-size" fit. The external surface of electronics unit 31B is in intimate contact with the inside of housing 31A and therefore cannot move relative to housing 31A.

In some embodiments, electronics unit 31B comprises components (electronic, mechanical, or otherwise) (not shown) mounted within a support structure (not shown). The support structure may comprise a carbon fiber tube, for example. The support structure may be manufactured with an external diameter substantially equal to the interior diameter of housing 31A. The components may be potted within the support structure by a potting agent (e.g. epoxy, Dow Corning Sylgard® 184, etc.).

Electronics unit 31B may be inserted into or removed from probe housing 31A by opening housing 31A (e.g. by removing a cap at one end of housing 31A or separating housing 31A into two parts at a joint) and sliding electronics unit 31B into or out of probe housing 31A. A lubricant may be used to ease insertion. FIGS. 3B and 3C are longitudinal and vertical cross sections, respectively, of an example downhole probe 31.

Figure 8:
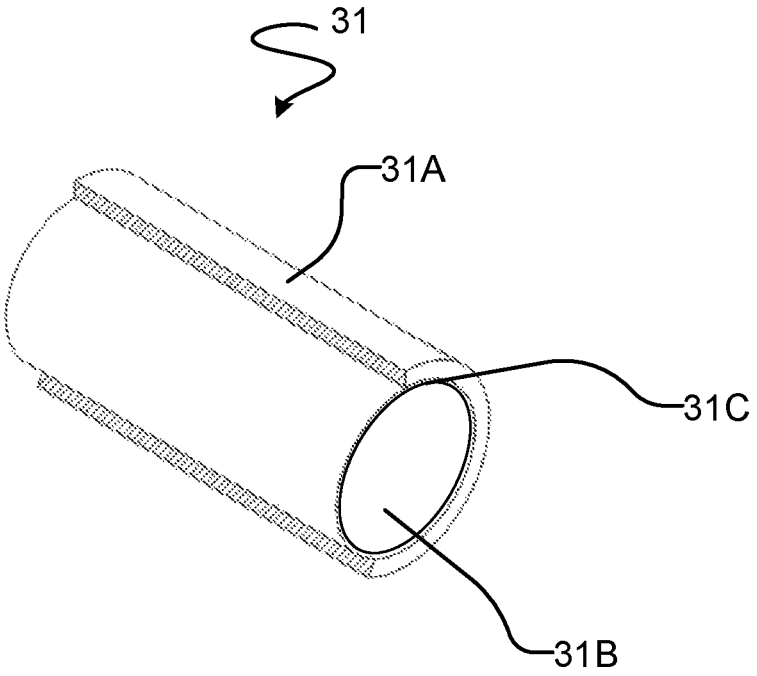
FIG. 8 is a schematic view of a probe according to one embodiment of the invention.

It is not mandatory that the outer surface of the electronics unit be in direct contact with the probe housing. In some embodiments a thin layer of material 31C may be provided between electronics unit 31B and probe housing 31A, as illustrated in FIG. 8. This layer of material 31C may be bonded to electronics unit 31B or to probe housing 31A or may comprise a tubular sleeve. The layer of material 31C may advantageously have vibration damping properties that tend to reduce transmission of high-frequency vibrations to electronics unit 31B. For example, the layer of material may comprise a thin sleeve or coating of rubber, a suitable elastomer, a plastic or the like. The material of the layer may be resiliently compressible to provide some cushioning for probe 31 while still providing full-length size-on-size mechanical coupling between electronics unit 31B and probe housing 31A. Where such a layer of material is provided, it is generally desirable that the layer of material fills the gap between electronics unit 31B and probe housing 31A and extends substantially the full length of electronics unit 31B.

The thin layer of material may optionally be electrically conductive or electrically-insulating. In some embodiments the layer of material comprises two or more electrically conductive parts separated by electrically insulating parts.

In some alternative embodiments, electronics unit 31B forms a size-on-size fit with housing 31A for only part of the length of housing 31A. In some embodiments, only 99%, 95%, 90%, 80%, or 50% of the outer lateral surface of electronics unit 31B forms a size-on-size fit with the inner wall of probe housing 31A.

In some embodiments, electronics unit 31B comprises a plurality of distinct modules. The modules may be coupled together with one another or separate. In such embodiments, one or more of the modules of the electronics unit may form a size-on-size fit within probe housing 31A. In some embodiments probe 31 comprises a plurality of coupled-together sections. Each section may comprise an electronics unit 31B mounted within a probe housing 31A.

In the illustrated embodiment, probe 31 is cylindrical in form (i.e. its cross sections are circles). In other embodiments, probe 31 may have cross sections of other shapes, such as oval or polygonal. In some embodiments, the cross section of the bore of probe housing 31A has a round or non-round shape which corresponds to the cross-sectional shape of electronics unit 31B to allow for a size-on-size fit between electronics unit 31B (or other active components housed within probe 31) and probe housing 31A.

In probe 31, there is no lateral gap between probe electronics unit 31B and probe housing 31A. This structure prevents lateral movement of electronics unit 31B relative to probe housing 31A, and thereby prevents electronics unit 31B from striking probe housing 31A with any significant velocity.

Electronics unit 31B is mechanically coupled to probe housing 31A by the size-on-size fit between these components. This mechanically-coupled structure, by virtue of its increased stiffness, has a higher resonant frequency than either of its component parts. Additionally, since electronics unit 31B is prevented from moving within probe housing 31A, probe housing 31A and electronics unit 31B cannot accelerate significantly with respect to one another and collide. Consequently, probe 31 may be less susceptible to damage from the low frequency vibrations which typically accompany drilling operations than a prior downhole probe of the type illustrated in FIGS. 2A to 2C.

By contrast, in probe 21, electronics unit 21B has unsupported portions 21E between shock rings 21C. If housing 21A is subjected to vibrations then vibrations will be transferred through shock rings 21C to electronics unit 21B, thereby inducing vibration of electronics unit 21B. If either housing 21A or electronics unit 21B is made to vibrate at or near a resonant frequency then the amplitude of the vibration may become relatively large, increasing the likelihood of damage to probe 21. Unsupported portions 21E of electronics unit 21B may vibrate with different frequencies, phases, or amplitudes than probe housing 21A. Thus unsupported portions 21E may experience vibrations of significant amplitudes. Such vibrations may harm unsupported portions 21E and may also cause unsupported portions 21E to flex enough that they impact housing 21A. Further, since shock rings 21C are very thin, they tend to transfer shocks to electronics unit 21B. Electronics unit 21B may, in some circumstances, suffer damage from such vibrations and impacts.

The construction of probe 31 may provide one or more of the following benefits:

- Providing a size-on-size fit between electronics unit 31B and probe housing 31A eliminates the need for shock rings 21C or similar apparatus. This may reduce manufacturing, service, and maintenance costs.
- The construction of probe 31 without shock rings 21C may also simplify assembly of probe 31.
- Probe 31 has no shock rings 21C and so cannot be harmed by failure of one or more shock rings 21C.
- The size-on-size fit allows housing 31A to provide continuous support to electronics unit 31B along up-to its entire length. Housing 31 may thereby act to reduce localized bending of electronics unit 31B.
- Since probe 31 has no gap 21D probe 31 can accommodate more electronics or other equipment than could fit in a probe 21 having the same housing dimensions. Use of the internal volume of probe 31 may be more efficient than could be achieved with a longer, thinner electronics unit.
- The frequencies of vibrational modes of the probe are increased as a result of mechanical coupling between the housing 31A and electronics package 31B.
- The close tolerance fit between electronics unit 31B and housing 31A may be made even tighter as a result of external pressure downhole, thereby locking electronics unit 31B and housing together.
- Electronics unit 31B and probe housing 31A cannot bang into one another because they cannot move relative to one another.
- The material of housing 31A may be thinner in some embodiments than would otherwise be required to resist downhole pressures as it is internally-supported.

Downhole probes are typically required to be small in diameter so that they do not obstruct too much of the cross-sectional area of the bore of the drill string in which they are located. Standard drill collars of the type often used in drilling wellbores have bore diameters in the range of 2¼ inches to about 3½ inches (6 cm to 9 cm). Table I provides dimensions of some example standard drill collars. These dimensions provide appropriate strength for typical drilling operations and have been established based on many years of industry experience.

In order to fit into the bores of standard drill collars while still leaving adequate space for the flow of drilling fluid, a typical downhole probe must have an outside diameter of less than 2 inches (5 cm) (for example downhole probes having diameters of 1¼ inches [3 cm], 1¾ inches [4 cm] or 1⅞ inches [5 cm] are commonly used). A downhole probe of a larger diameter would result in a small cross section for passage of drilling fluid which, in turn would result in fluid velocities exceeding 41 feet/sec (about 12½ m/s) at typical flow rates required for drilling. The required flow rates tend to increase for larger-diameter drill bits. Table II provides some example flow rates.

TABLE II

EXAMPLE FLOW RATES

| External Diameter (Inches) | Cross sectional area of bore | Typical required flow rate (US Gallons per Minute) | Cross sectional area required to provide flow rate with velocity less than 41 feet/sec (about 12½ m/s) |
|---|---|---|---|
| 4¾ | 5.7 $in^2$ (37 $cm^2$) | <350 (<22 l/s) | 2¾ $in^2$ (18 $cm^2$) |
| 6½ | 6.2 $in^2$ (40 $cm^2$) | <550 (<34 l/s) | 5.3 $in^2$ (34 $cm^2$) |
| 8 | 8.3 $in^2$ (54 $cm^2$) | <1100 (<68 l/s) | 10.6 $in^2$ (68 $cm^2$) |

Probes according to some embodiments of the invention are significantly larger in diameter than prior art probes. For example, in some embodiments, a probe 31 has a probe housing 31A that has an outer diameter of more than 2 inches (5 cm). As an example, in some embodiments, housing 31A has an outer diameter of 2.54 inches (6 cm). Increasing the diameter of the probe by even a small amount can very significantly increase the overall stiffness of the probe since stiffness of a member (e.g. a probe housing) tends to increase with a higher power (e.g. the cube) of the diameter with all other factors equal. Further, as explained elsewhere in this disclosure, such larger-diameter probes may be used in drill string sections that have relatively small diameters while still maintaining sufficient cross-sectional area around the probe for the flow of drilling fluid past the probe at suitably high rates for drilling and at suitably low flow velocities. This may be achieved, for example by supporting probes in thinner-walled drill string sections of high-strength materials. Such probes may be used in drill string sections having outer diameters of a wide range of sizes from, for example 4¾ inches (12 cm) or less up to larger sizes such as 8 (20 cm), 11 (28 cm) or 13 (33 cm) inches or more.

Increasing the diameter of the probe also significantly increases the volume within the probe for each unit of length of that probe. The increased cross-sectional area available for active components of the probe also tends to allow a much more volumetrically-efficient arrangement of components within the probe with significantly less wasted volume.

As noted above, a diameter of 2 inches (5 cm) or more can result in the probe obstructing too much of the bore of a standard-sized drill collar (e.g. a drill collar having dimensions as specified by the API standards) to maintain flow velocities below 41 feet/sec (about 12½ m/s). In some embodiments this is addressed by providing drill collars for use in conjunction with the probes that have standard outside diameters but walls that are thinner than those of standard drill collars such that, for a given outside diameter the drill collar has a larger area bore than the standard collar of the same outside diameter. The thin-walled drill collars may be made to have strength equal to or exceeding that of standard drill collars while exhibiting required bending strength and bending strength ratios at connections to other drill string sections.

Strong drill string sections having larger than standard bores and standard or near-standard outside diameters may be achieved by fabricating the thin-wall drill collars of high strength materials. For example, standard drill collars are often made from steel that has a yield strength of 110,000 psi (765 $MN/m^2$). A thin-walled collar may be made of high-strength steel (such as a high strength non-magnetic stainless steel alloy) having a yield strength of 130,000 psi (896 $MN/m^2$) or more (e.g. 140,000 psi [965 $MN/m^2$] or 160,000 psi [1103 $MN/m^2$]) such that the collar meets or exceeds the strength of the standard drill collar, has an outside diameter that matches that of the standard drill collar and yet, due to the reduced wall thickness, provides a bore large enough to accommodate a large diameter probe and still leave a large enough cross-section of the bore available for carrying drilling fluid. The cross section available for carrying drilling fluid may exceed that of standard collars using smaller diameter probes in some embodiments. Table III provides some example dimensions for drill collars with standard outside diameters and extra-large inside diameters.

TABLE III

SOME EXAMPLE NON-STANDARD DRILL COLLAR DIMENSIONS

| External Diameter (inches) | Internal Diameter (inches) |
|---|---|
| 5 (13 cm) (compatible with 4¾ (12 cm) drill collars) | 3.63 (9 cm) |
| 6⅝ (17 cm) | 4.5 (11 cm) |
| 8 (20 cm) | 6 3/64 (15 cm) |
| 9 (23 cm) to 10 (25 cm) | 6¾ (17 cm) or greater |

A section of drill collar for use with a probe may, in addition to having a non-standard larger bore size, have one or more features for supporting the probe. For example, the drill collar section may comprise one or more landing steps or other features for holding the probe axially in the bore of the drill collar. Such a drill collar may optionally have one or more transition sections which smoothly reduce the bore diameter of the drill collar to match the bore of standard drill collars that may be coupled to the drill collar at one or both ends.

In order to fit the required systems inside a small-diameter form factor, downhole probes typically have very large ratios of length to diameter. For example, length-to-diameter ratios far exceeding 100:1 are not uncommon. Some downhole probes are, for example, 1.875 (5 cm) or 1.75 (4 cm) inches in diameter and approximately 30 feet (9 m) or more in length. A probe with such dimensions is quite fragile. Such a probe may be damaged during handling. It may also be damaged by the harsh downhole environment, particularly by resonant vibrations, including those caused by the flow of drilling fluid past the probe and stick-slip shocks from drilling which may present accelerations having lateral, axial, and torsional components.

In some embodiments the probes have much smaller ratios of length to diameter than prior art probes. In some such embodiments the ratio of length to outer diameter for the probe is 70:1 or less. For example, in an example embodiment, probe housing 31A is approximately 2½ inches (6 cm) in diameter and approximately 13 feet (4 m) long. In an example embodiment a length to diameter ration of the probe is 60:1. Making a probe larger in diameter can permit making the probe shorter while providing the same functionality. A shorter probe tends to have a greater effective stiffness all other factors equal (since the frequencies of transverse vibrational modes depends on both length and stiffness these frequencies can be caused to increase by making the probe shorter, making the probe stiffer—making the probe to have a higher elastic modulus—or both). Making a probe shorter and larger in diameter tends to raise the frequencies of vibrational modes of the probe which, in turn tends to reduce the amplitude of vibrations induced in the probe by the predominantly low-frequency vibrations resulting from drilling operations.

In some embodiments the probe is constructed so that the frequencies of its lowest-frequency vibrational modes are well in excess of 4 to 10 Hz where downhole vibrations tend to have maximum amplitudes. For example, the frequency of a first fundamental (F1) vibration mode of the probe when pinned at its ends may be in excess of 20 Hz. The frequency may be further increased by mechanically coupling the probe to the drill string, as described below. Achieving a probe that does not have low-frequency vibrational modes that would be resonantly excited by low-frequency downhole vibrations may be achieved by one or more of: making the probe shorter, making the probe larger in diameter (stiffer), making the contents of the probe a size-on-size fit with the probe housing (which makes the probe stiffer), using a centralizer to mechanically couple the probe to the drill collar and supporting the probe in the drill collar with two or more supports that hold the probe against axial and/or transverse motion (for example by spiders or other supports at each end of the probe—such supports can be particularly effective where one or both supports holds the supported portion of the probe parallel to a centerline of the drill string section in which the probe is supported). In some embodiments the probe has a length not exceeding 30 feet (9 m) and a diameter of more than 1.875 inches (5 cm).

Further increases in the frequencies of vibrational modes may be achieved by mechanically coupling the probe to the drill string section(s) through which it passes (which tends to make the probe effectively stiffer). Such mechanical coupling advantageously is provided for an extended distance along the length of the probe in which case the mechanical coupling can additionally be effective at suppressing vibrational modes by restraining possible motions of the probe. Such coupling can be especially effective at suppressing a fundamental transverse vibrational mode and its lower harmonics (e.g. F1, F2, F3). With such structures, the frequencies of vibrational modes that could possibly be excited with energies sufficient to make damage to the probe likely can be made to be significantly higher than the low frequency (e.g. 1-10 Hz) vibrations that are predominant in the downhole environment. In some embodiments, the frequencies of the third and higher vibrational modes (F3 and up) of a probe are all in excess of 10 Hz. In some embodiments, the frequencies of the third and higher vibrational modes (F3 and up) of a probe are all in excess of 40 Hz.

Although based on assumptions (such as uniform mass per unit length) that may not be precisely satisfied by a real probe, the following formula provides a useful indication regarding how changes to the geometry of a probe can affect the frequency of transverse vibrational modes of the probe:

$$\omega_n = \beta_n^2\sqrt{\frac{EI}{\rho A}} = (\beta_n L)^2\sqrt{\frac{EI}{\rho A L^4}}$$

In this formula, L is the length of the probe, A is the cross-sectional area of the probe, ρ is the mass density of the probe, E is the elastic modulus of the probe, I is the moment of inertia of the probe, βn is the wavenumber for vibrations in the nth mode and ωn is the frequency of vibrations in the nth mode.

Similar calculations may be performed to determine natural frequencies of torsional vibrations of the probe. These frequencies depend on the torsional stiffness of the probe as well as its moment of inertia. Torsional stiffness increases rapidly with increases in probe diameter. As with transverse vibrational modes, making a probe larger in diameter and shorter can significantly increase the natural frequencies of torsional modes. Mechanically coupling the probe to a drill string section in a manner that resists rotation of the probe relative to the drill string section can further increase the natural frequencies of such torsional modes.

Short and wide probes may provide one or more of the following benefits:

- They may be less susceptible to damage than conventional probes which have small cross sections and long lengths. For example, they may have increased resonant frequencies and thus may be less susceptible to damage caused by low frequency vibrations.
- They may be easier to transport due to their decreased length.
- They may have fewer probe separation points, and thus they may require fewer intersectional connectors and mechanical fixtures. Some short probes may require no intersectional connectors or mechanical fixtures at all.
- Reducing the number of couplings between different probe sections reduces the number of electrical interconnections between different probe sections (such electrical interconnections are vulnerable to failure and so eliminating electrical connections between different sections can significantly improve probe reliability).
- They may provide space for larger internal components, due to their increased width. Larger components may be stronger and/or less expensive than smaller components. Larger components (e.g. larger gamma detectors or larger diameter batteries) may yield better performance (e.g. one or more of greater sensitivity, greater accuracy, lower power consumption, etc.).
- The packing of components within the probe may be more volumetrically efficient than would be practical with a smaller-diameter probe.

Figure 9:
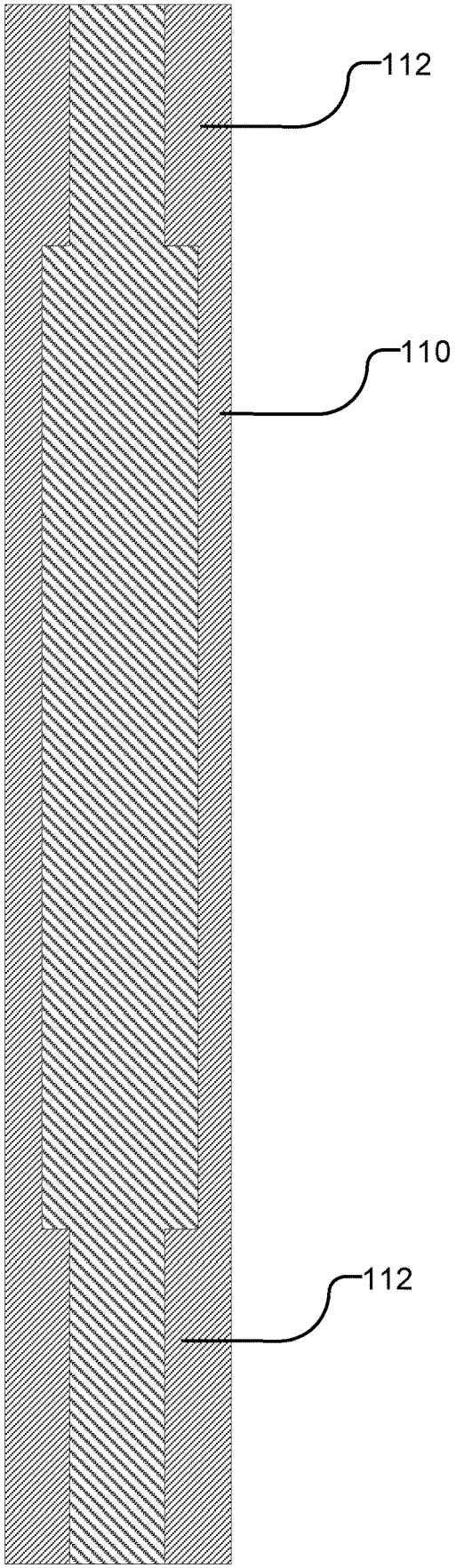
FIG. 9 is a longitudinal cross section of a drill pipe according to one embodiment of the invention.

FIG. 9 illustrates a drill collar 110 that has a wall that is thinner than walls of two adjacent standard drill string sections 112. Drill collar 110 has a larger-area bore than the drill string sections 112 having equal outer diameter.

A further feature that may be provided is a coupling for mechanically coupling a probe to a drill collar in such a manner that the drill collar provides support for the probe along all or a significant portion of the length of the probe. Such a coupling can be particularly advantageous in combination with a larger-diameter probe.

Figure 4:
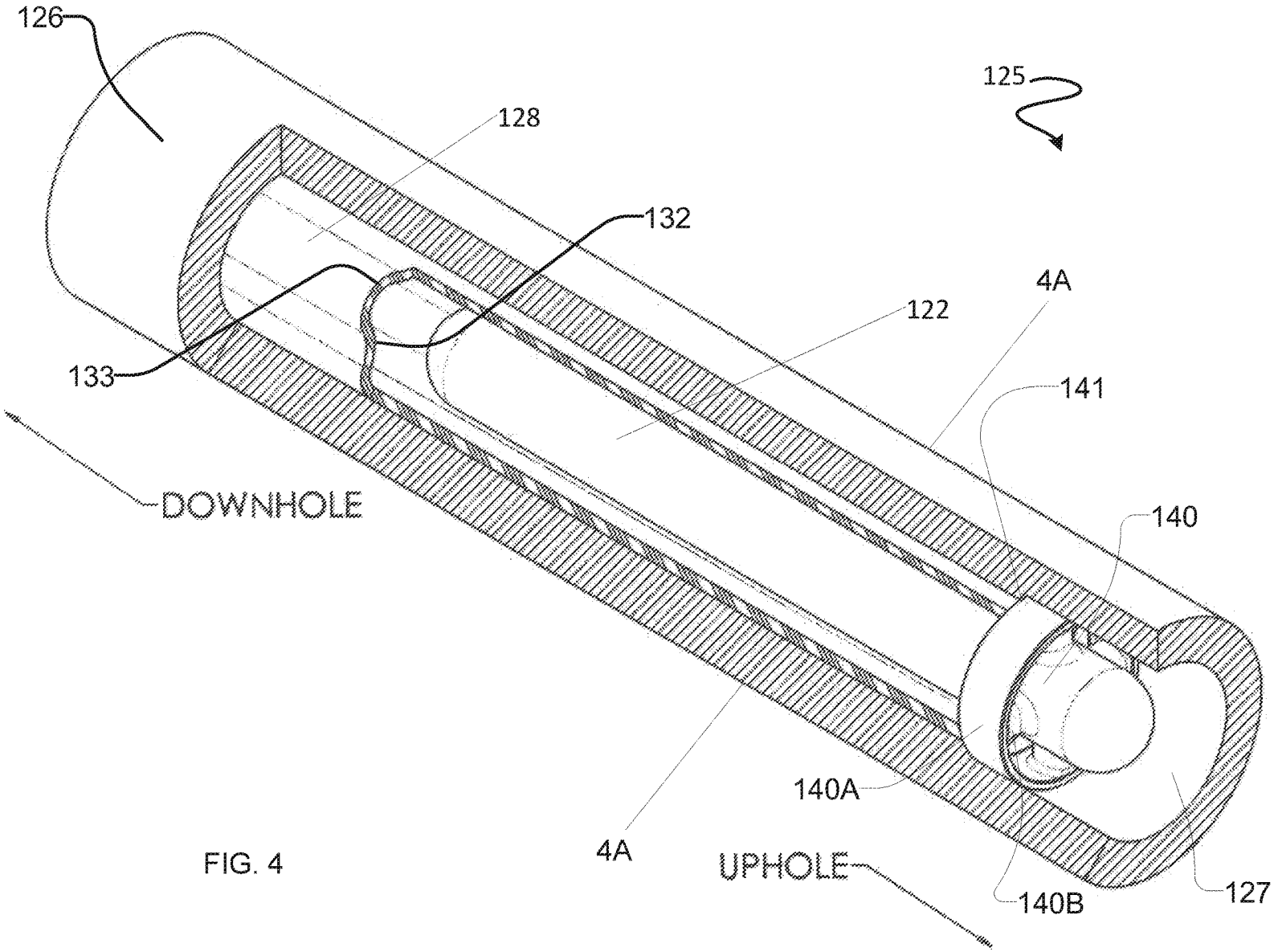
FIG. 4 is a perspective cutaway of a downhole assembly containing an electronics package.
Figure 4A:
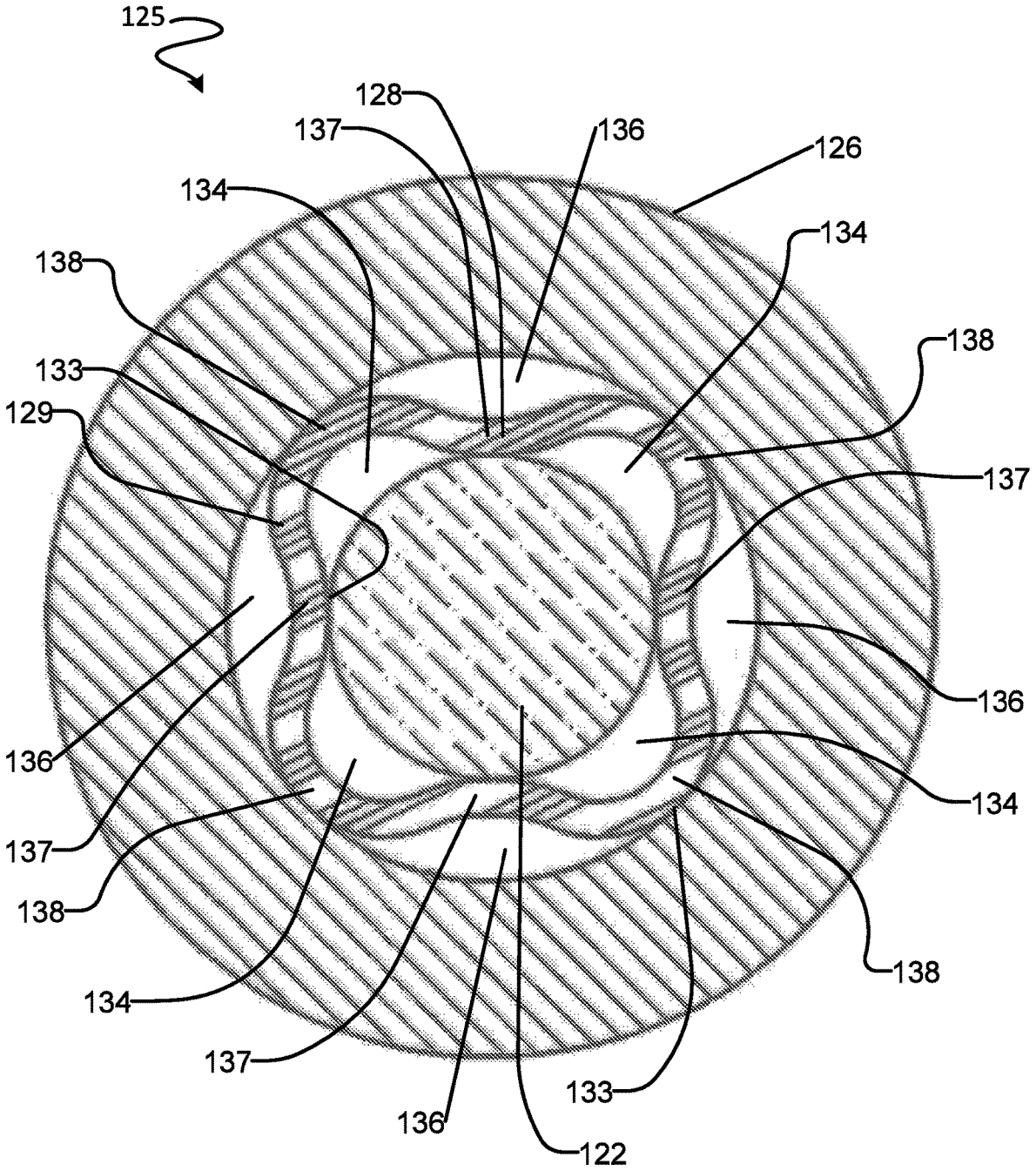
FIG. 4A is a view taken in section along the line 4A-4A of FIG. 4.
Figure 4B:
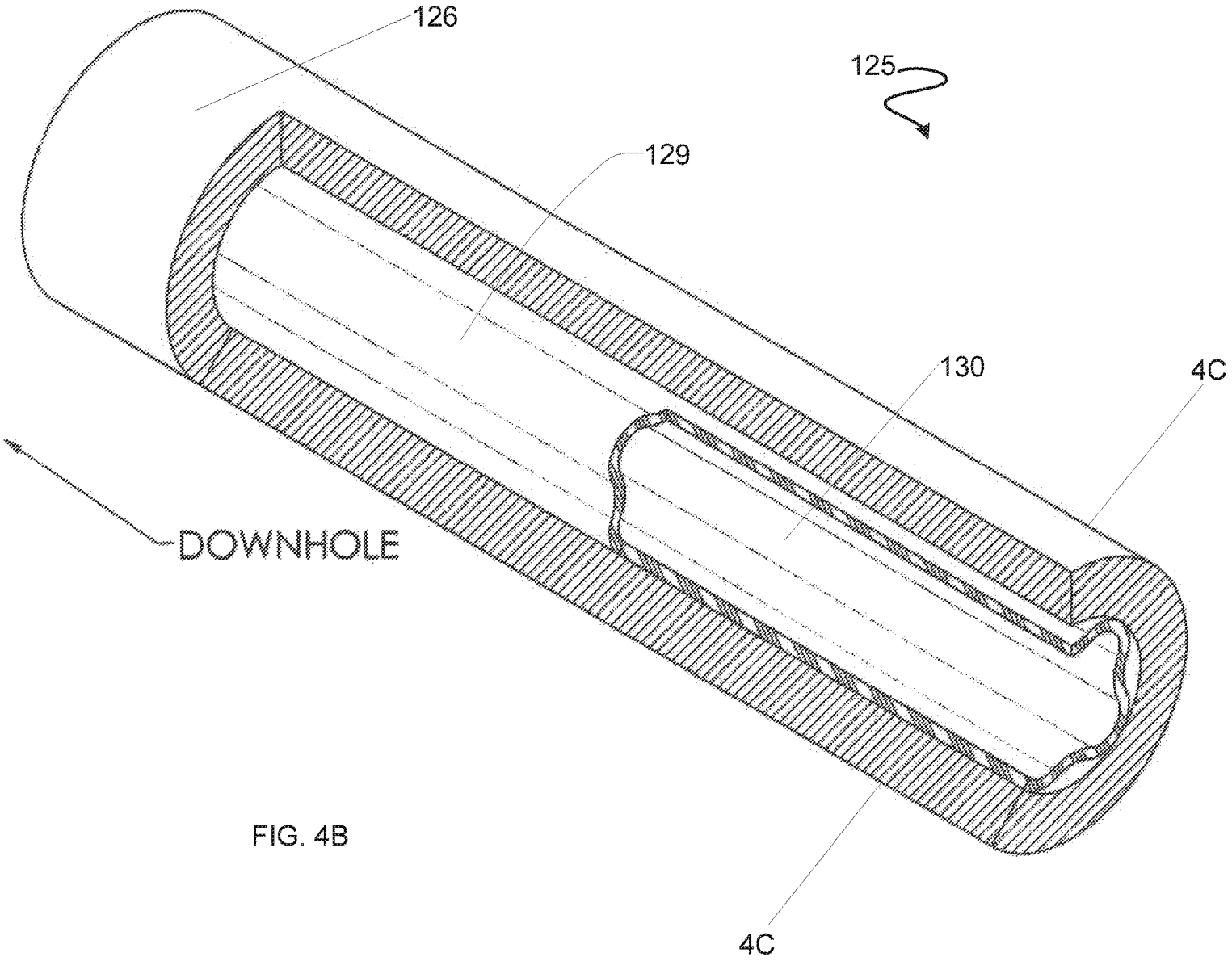
FIG. 4B is a perspective cutaway view of a downhole assembly not containing an electronics package.
Figure 4C:
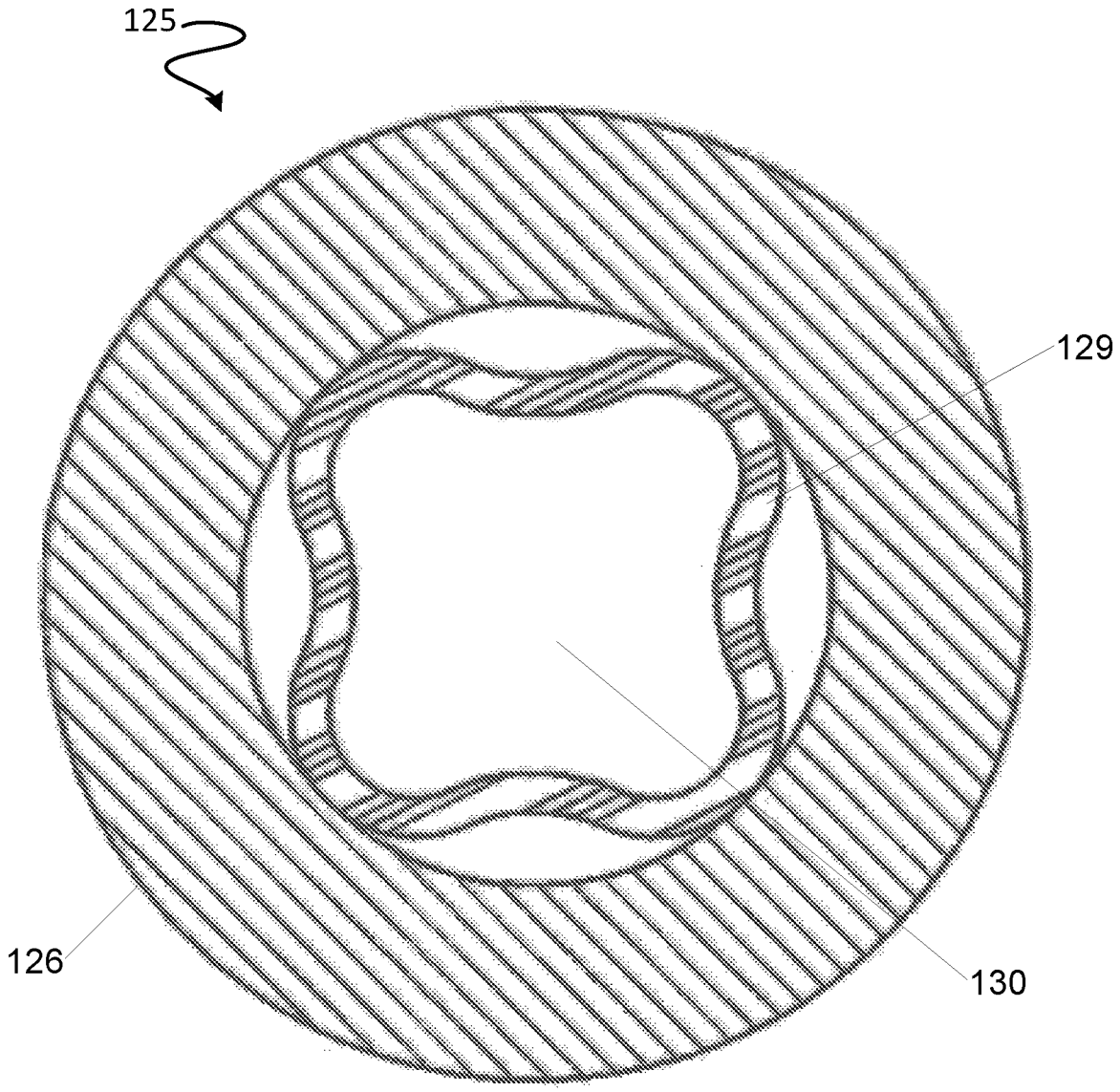
FIG. 4C is a view taken in section along the line 4C-4C of FIG. 4B.

FIGS. 4 and 4A show a downhole assembly 125 comprising an electronics package 122 supported within a bore 127 in a section 126 of drill string. Section 126 may, for example, comprise a drill collar, a gap sub or the like. Electronics package 122 is smaller in diameter than bore 127. Electronics package is centralized within bore 127 by a tubular centralizer 128. FIGS. 4B and 4C show the downhole assembly 125 without the electronics package 122.

Centralizer 128 comprises a tubular body 129 having a bore 130 for receiving electronics package 122 and formed to provide axially-extending inner support surfaces 132 for supporting electronics package 122 and outer support surfaces 133 for bearing against the wall of bore 127 of section 126. As shown in FIG. 4A, centralizer 128 divides the annular space surrounding electronics package 122 into a number of axial channels. The axial channels include inner channels 134 defined between centralizer 128 and electronics package 122 and outer channels 136 defined between centralizer 128 and the wall of section 126.

Centralizer 128 may be provided in one or more sections and may extend substantially continuously for any desired length along electronics package 122. In some embodiments, centralizer 128 extends substantially the full length of electronics package 122. In some embodiments, centralizer 128 extends to support electronics package 122 substantially continuously along at least 60% or 70% or 80% of an unsupported portion of electronics package 122 (e.g. a portion of electronics package 122 extending from a point at which electronics package 122 is coupled to section 126 to an end of electronics package 122). In some embodiments centralizer 128 engages substantially all of the unsupported portion of electronics package 122. Here, 'substantially all' means at least 95%.

In the illustrated embodiment, inner support surfaces 132 are provided by the ends of inwardly-directed longitudinally-extending lobes 137 and outer support surfaces 133 are provided by the ends of outwardly-directed longitudinally-extending lobes 138. The number of lobes may be varied. The illustrated embodiment has four lobes 137 and four lobes 138. However, other embodiments may have more or fewer lobes. For example, some alternative embodiments have 3 to 8 lobes 138.

It is convenient but not mandatory to make the lobes of centralizer 128 symmetrical to one another. It is also convenient but not mandatory to make the cross-section of centralizer 128 mirror symmetrical about an axis passing through one of the lobes. It is convenient but not mandatory for lobes 137 and 138 to extend parallel to the longitudinal axis of centralizer 128. In the alternative, centralizer 128 may be formed so that lobes 137 and 138 are helical in form.

Centralizer 128 may be made from a range of materials from metals to plastics suitable for exposure to downhole conditions. Some non-limiting examples are suitable thermoplastics, elastomeric polymers, rubber, copper or copper alloy, alloy steel, and aluminum. For example centralizer 128 may be made from a suitable grade of PEEK (Polyetheretherketone) or PET (Polyethylene terephthalate) plastic. Where centralizer 128 is made of plastic the plastic may be fiber-filled (e.g. with glass fibers) for enhanced erosion resistance, structural stability and strength.

The material of centralizer 128 should be capable of withstanding downhole conditions without degradation. The ideal material can withstand temperature of up to at least 150 C (preferably 175 C or 200 C or more), is chemically resistant or inert to any drilling fluid to which it will be exposed, does not absorb fluid to any significant degree and resists erosion by drilling fluid. In cases where centralizer 128 contacts metal of electronics package 122 and/or bore 127 (e.g. where one or both of electronics package 122 and bore 127 is uncoated) the material of centralizer 128 is preferably not harder than the metal of electronics package 122 and/or section 126 that it contacts. Centralizer 128 should be stiff against deformations so that electronics package 122 is kept concentric within bore 127. The material characteristics of centralizer 128 may be uniform.

The material of centralizer 128 may also be selected for compatibility with sensors associated with electronics package 122. For example, where electronics package 122 includes a magnetometer, it is desirable that centralizer 128 be made of a non-magnetic material such as copper, beryllium copper, or a suitable thermoplastic.

In cases where centralizer 128 is made of a relatively unyielding material, a layer of a vibration damping material such as rubber, an elastomer, a thermoplastic or the like may be provided between electronics package 122 and centralizer 128 and/or between centralizer 128 and bore 127. The vibration damping material may assist in preventing 'pinging' (high frequency vibrations of electronics package 122 resulting from shocks).

Centralizer 128 may be formed by extrusion, injection molding, casting, machining, or any other suitable process. Advantageously the wall thickness of centralizer 128 can be substantially constant. This facilitates manufacture by extrusion. In the illustrated embodiment the lack of sharp corners reduces the likelihood of stress cracking, especially when centralizer 128 has a constant or only slowly changing wall thickness. In an example embodiment, the wall of centralizer 128 has a thickness in the range of 0.1 to 0.3 inches (2 to 8 mm). In a more specific example embodiment, the wall of centralizer 128 is made of a thermoplastic material (e.g. PET or PEEK) and has a thickness of about 0.2 inches (about 5 mm).

Centralizer 128 is preferably sized to snuggly grip electronics package 122. Preferably insertion of electronics package 122 into centralizer 128 resiliently deforms the material of centralizer 128 such that centralizer 128 grips the outside of electronics package 122 firmly. Electronics package 122 may be somewhat larger in diameter than the space between the innermost parts of centralizer 128 to provide an interference fit between the electronics package and centralizer 128. The size of the interference fit is an engineering detail but may be ½ mm or so (a few hundredths of an inch).

In some applications it is advantageous for the material of centralizer 128 to be electrically insulating. For example, where electronics package 122 comprises an EM telemetry system, providing an electrically-insulating centralizer 128 can prevent the possibility of short circuits between section 126 and the outside of electronics package 122 as well as increase the impedance of current paths through drilling fluid between electronics package 122 and section 126.

Electronics package 122 may be locked against axial movement within bore 127 in any suitable manner. For example, by way of pins, bolts, clamps, or other suitable fasteners. In the embodiment illustrated in FIG. 4, a spider 140 having a rim 140A supported by arms 140B is attached to electronics package 122. Rim 140A engages a ledge 141 formed at the end of a counterbore within bore 127. Rim 140A is clamped tightly against ledge 141 by a nut 144 (see FIGS. 5 and 5A) that engages internal threads on surface 142.

In some embodiments, centralizer 128 extends from spider 140 or other longitudinal support system for electronics package 122 continuously to the opposing end of electronics package 122. In other embodiments one or more sections of centralizer 128 extend to grip electronics package 122 over at least 70% or at least 80% or at least 90% or at least 95% of a distance from the longitudinal support to the opposing end of electronics package 122.

In some embodiments electronics package 122 has a fixed rotational orientation relative to section 126. For example, in some embodiments spider 140 is keyed, splined, has a shaped bore that engages a shaped shaft on the electronics package 122 or is otherwise non-rotationally mounted to electronics package 122. Spider 140 may also be non-rotationally mounted to section 126, for example by way of a key, splines, shaping of the face or edge of rim 140A that engages corresponding shaping within bore 127 or the like.

In some embodiments electronics package 122 has two or more spiders, electrodes, or other elements that directly engage section 126. For example, electronics package 122 may include an EM telemetry system that has two spaced apart electrical contacts that engage section 126. In such embodiments, centralizer 128 may extend for a substantial portion of (e.g. at least 50% or at least 65% or at least 75% or at least 80% or substantially the full length of) electronics package 122 between two elements that engage section 126.

Figure 5:
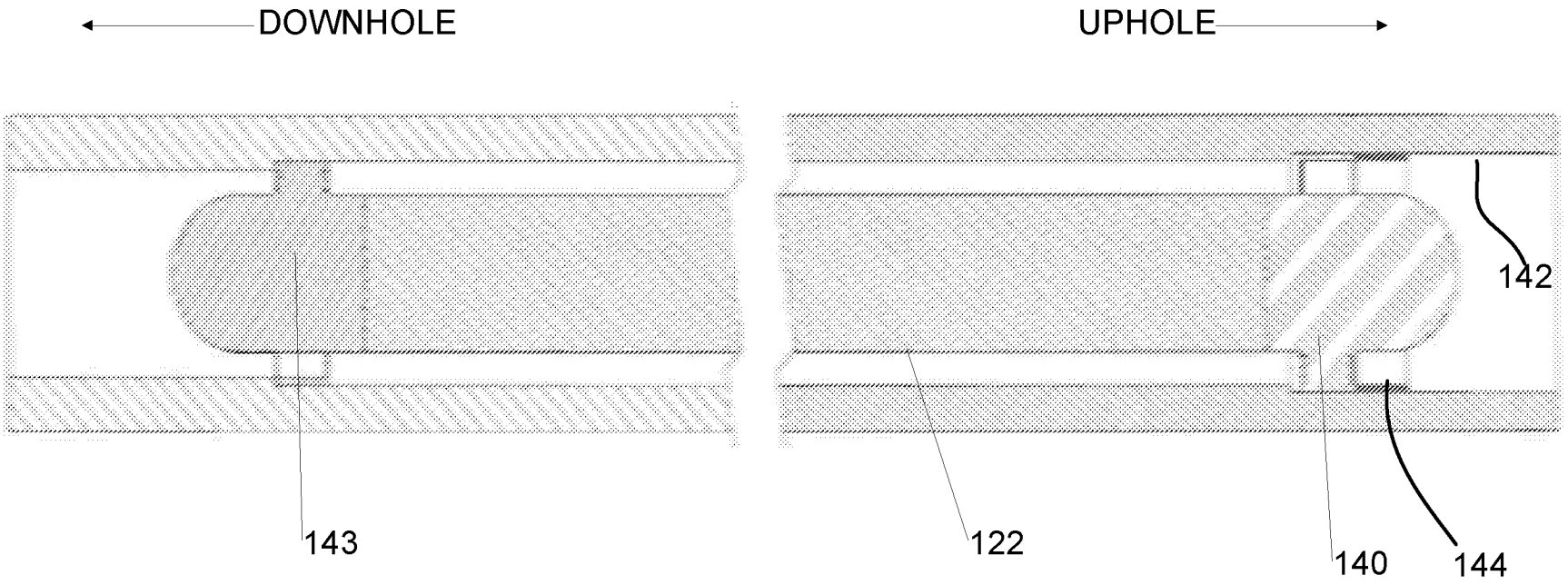
FIG. 5 is a schematic illustration of one embodiment of the invention where an electronics package is supported between two spiders.

In an example embodiment shown in FIG. 5, electronics package 122 is supported between two spiders 140 and 143. Each spider 140 and 143 engages a corresponding landing ledge within bore 127. Each spider 140 and 143 may be non-rotationally coupled to both electronics package 122 and bore 127. Centralizer 128 may be provided between spiders 140 and 143. Optionally spiders 140 and 143 are each spaced longitudinally apart from the ends of centralizer 128 by a short distance (e.g. up to about ½ meter (18 inches) or so) to encourage laminar flow of drilling fluid past electronics package 122.

It can be seen from FIG. 4A that, in cross section, the wall 129 of centralizer 128 extends around electronics package 122. Wall 129 is shaped to provide outwardly projecting lobes 138 that are outwardly convex and inwardly concave as well as inwardly-projecting lobes 137 that are inwardly convex and outwardly concave. In the illustrated embodiment, each outwardly projecting lobe 138 is between two neighbouring inwardly projecting lobes 137 and each inwardly projecting lobe 137 is between two neighbouring outwardly projecting lobes 138. The wall of centralizer 128 is sinuous and may be constant in thickness to form both inwardly projecting lobes 137 and outwardly projecting lobes 138.

In the illustrated embodiment, portions of the wall 129 of centralizer 128 bear against the outside of the electronics package 122 and other portions of the wall 129 of centralizer 128 bear against the inner wall of the bore 127 of section 126. As one travels around the circumference of centralizer 128, centralizer 128 makes alternate contact with electronics package 122 on the internal aspect of wall 129 of centralizer 128 and with section 126 on the external aspect of centralizer 128. Wall 129 of centralizer 128 zig zags back and forth between electronics package 122 and the wall of bore 127 of section 126. In the illustrated embodiment the parts of the wall 129 of centralizer 128 that extend between an area of the wall that contacts electronics package 122 and a part of wall 129 that contacts section 126 are curved. These curved wall parts are preloaded such that centralizer 128 exerts a compressive force on electronics package 122 and holds electronics package 122 centralized in bore 127.

When section 126 experiences a lateral shock, centralizer 128 cushions the effect of the shock on electronics package 122 and also prevents electronics package 122 from moving too much away from the center of bore 127. After the shock has passed, centralizer 128 urges the electronics package 122 back to a central location within bore 127. The parts of the wall 129 of centralizer 128 that extend between an area of the wall that contacts electronics package 122 and an area of the wall that contacts section 126 can dissipate energy from shocks and vibrations into the drilling fluid that surrounds them. Furthermore, these wall sections are preloaded and exert restorative forces that act to return electronics package 122 to its centralized location after it has been displaced.

As shown in FIG. 4A, centralizer 128 divides the annular space within bore 127 surrounding electronics package 122 into a first plurality of inner channels 134 inside the wall 129 of centralizer 128 and a second plurality of outer channels 136 outside the wall 129 of centralizer 128. Each of inner channels 134 lies between two of outer channels 136 and is separated from the outer channels 136 by a part of the wall of centralizer 128. One advantage of this configuration is that the curved, pre-tensioned flexed parts of the wall tend to exert a restoring force that urges electronics package 122 back to its equilibrium (centralized) position if, for any reason, electronics package 122 is moved out of its equilibrium position. The presence of drilling fluid in channels 134 and 136 tends to damp motions of electronics package 122 since transverse motion of electronics package 122 results in motions of portions of the wall of centralizer 128 and these motions transfer energy into the fluid in channels 134 and 136. In addition, dynamics of the flow of fluid through channels 134 and 136 may assist in stabilizing centralizer 128 by carrying off energy dissipated into the fluid by centralizer 128.

The preloaded parts of wall 129 provide good mechanical coupling of the electronics package 122 to the drill string section 126 in which the electronics package 122 is supported. Centralizer 128 may provide such coupling along the length of the electronics package 122. This good coupling to the drill string section 126, which is typically very rigid, can increase the resonant frequencies of the electronics package 122, thereby making the electronics package 122 more resistant to being damaged by high amplitude low frequency vibrations that typically accompany drilling operations.

Figure 6:
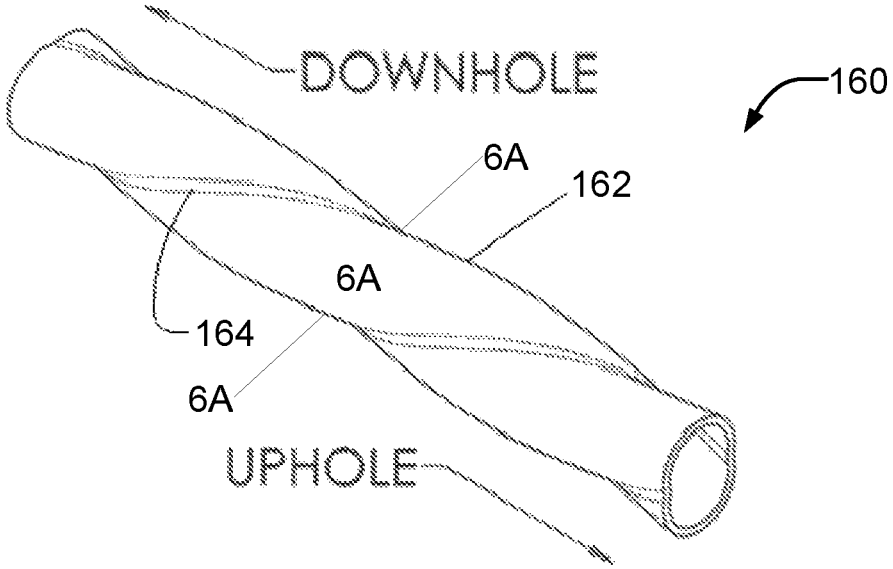
FIG. 6 is a perspective view of a centralizer according to one embodiment of the invention.
Figure 6A:
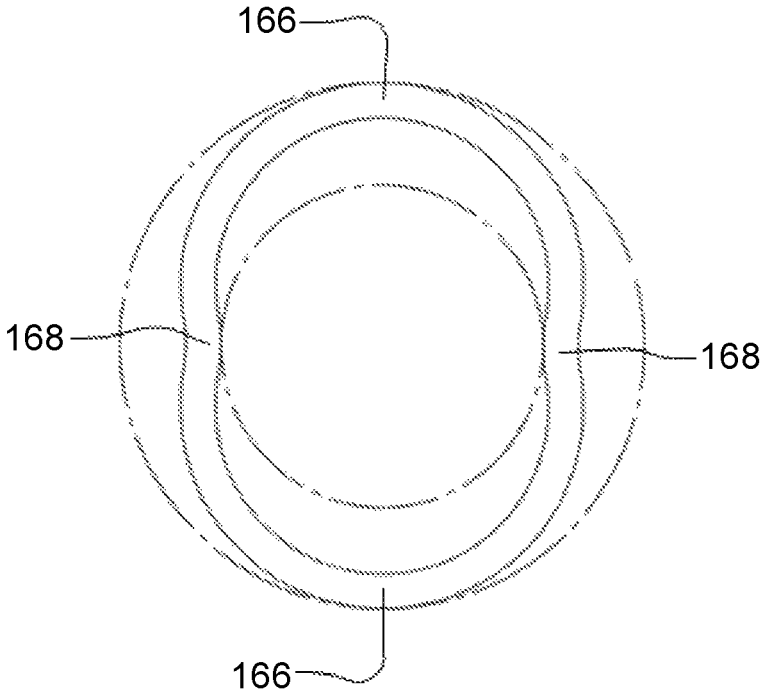
FIG. 6A is a view taken in section along the line 6A-6A of FIG. 6.

FIGS. 6 and 6A show an example centralizer 160 formed with a wall 162 configured to provide longitudinal ridges 164 that twist around the longitudinal centerline of centralizer 160 to form helixes. In the illustrated embodiment, centralizer 160 has a cross-sectional shape in which wall 162 forms two outwardly projecting lobes 166, which are each outwardly convex and inwardly concave and two inwardly projecting lobes 168. Centralizers configured to have other numbers of lobes may also be made to have a helical twist. For example, centralizers that, in cross section, provide 3 to 8 lobes may be constructed so that the lobes extend along helical paths.

Inwardly-projecting lobes 168 are configured to grip an electronics package by spiraling around the outer surface of the electronics package. The tubular body of centralizer 160 is subject to a twist so that the lobes become displaced in a rotated or angular fashion as one traverses along the length of centralizer 160. At each point along the electronics package 122 the electronics package 122 is held between two opposing lobes 168. The orientation of lobes 168 is different for different positions along the electronics package so that the electronics package is held against radial movement within the bore of centralizer 160. Each ridge 164 makes at least a half twist over the length of centralizer 160. In some embodiments, each ridge 164 makes at least one full twist around the longitudinal axis of centralizer 160 over the length of centralizer 160.

Figure 5B:
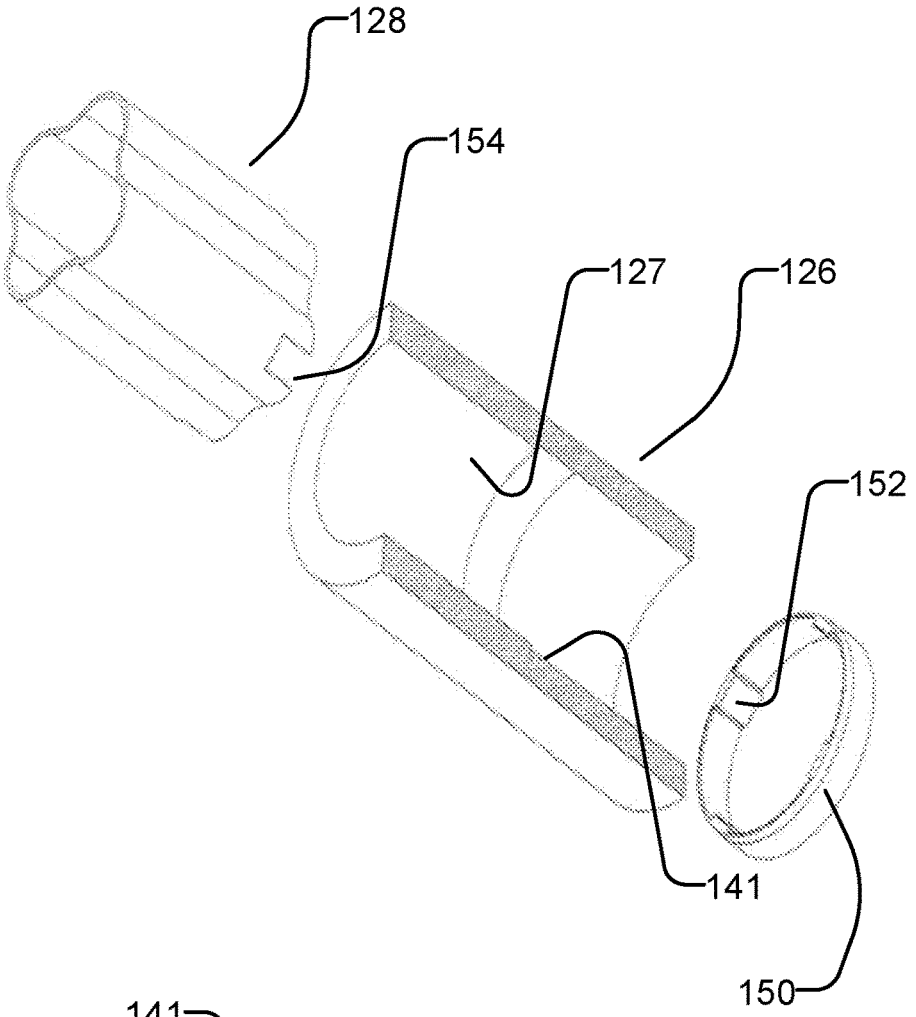
FIG. 5B is an exploded view showing one way to anchor a centralizer against rotation in the bore of a drill string. The anchor may also support the centralizer against longitudinal movement.
Figure 5A:
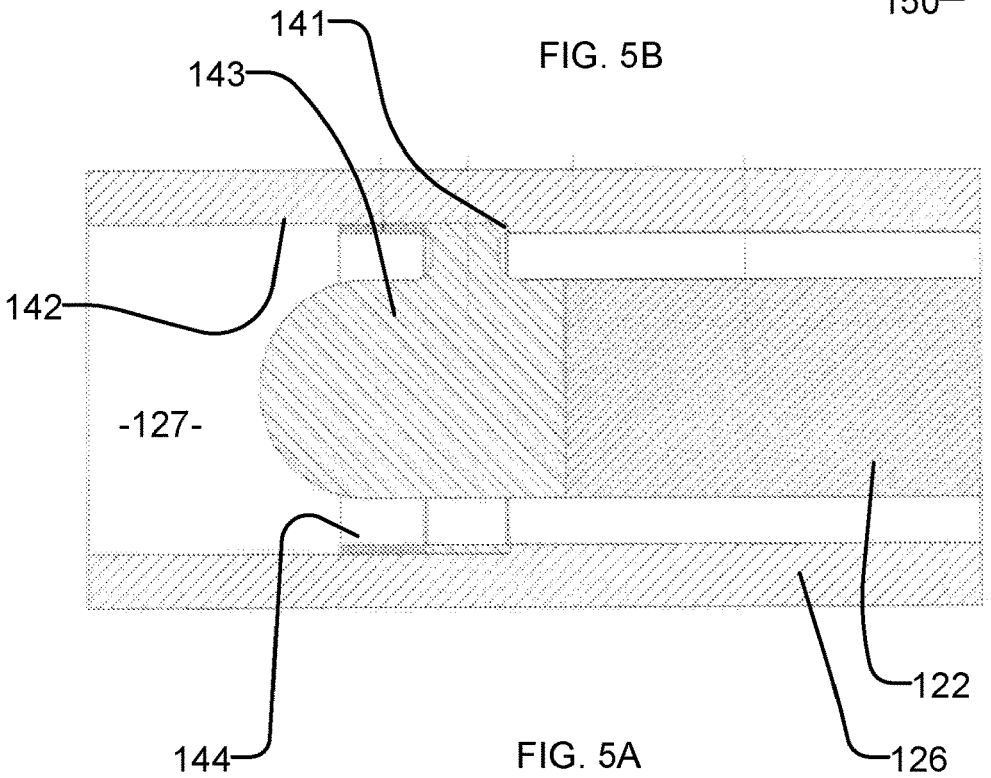
FIG. 5A is a detail showing one assembly for anchoring a downhole probe against longitudinal movement.

A centralizer as described herein may be anchored against longitudinal movement and/or rotational movement within bore 127 if desired. For example the centralizer may be keyed onto a landing shoulder in bore 127 and held axially in place by a threaded feature that locks it down. For example, the centralizer may be gripped between the end of one drill collar and a landing shoulder. FIG. 5B illustrates an example embodiment wherein a centralizer 128 engages features of a ring 150 that is held against a landing 141 within bore 127 of section 126. In the illustrated embodiment, notches 154 on an end of centralizer 128 engage corresponding teeth 152 on ring 150. Ring 150 may be held in place against landing 141 by means of a suitable nut, the end of an adjoining drill string section, a spider or other part of a probe or the like. In some embodiments, ring 150 is attached to or is part of a spider that supports a downhole probe in bore 127.

A centralizer as described herein may optionally interface non-rotationally to an electronics package 122 (for example, the electronics package 122 may have features that project to engage between inwardly-projecting lobes of a centralizer) so that the centralizer provides enhanced damping of torsional vibrations of the electronics package 122.

One method of use of a centralizer as described herein is to insert the centralizer into a section of a drill string such as a gap sub, drill collar or the like. The section has a bore having a diameter D1. The centralizer, in an uninstalled configuration free of external stresses prior to installation, has outermost points lying on a circle of diameter D2 with D2>D1. The method involves inserting the centralizer into the section. In doing so, the outermost points of the centralizer bear against the wall of the bore of the section and are therefore compressed inwardly. The configuration of centralizer 128 allows this to occur so that centralizer 128 may be easily inserted into the section. Insertion of centralizer 128 into the section moves the innermost points of centralizer 128 inwardly.

In some embodiments, centralizer 128 is inserted into the section until the end being inserted into the section abuts a landing step in the bore of the section. The centralizer may then be constrained against longitudinal motion by providing a member that bears against the other end of the centralizer. For example, the section may comprise a number of parts (e.g. a number of collars) that can be coupled together. The centralizer may be held between the end of one collar or other part of the section and a landing step.

After installation of the centralizer into the section, the innermost points on the centralizer lie on a central circle having a diameter D3. An electronics package or other elongated object to be centralized having a diameter D4 with D4>D3 may then be introduced longitudinally into centralizer. This forces the innermost portions of centralizer outwardly and preloads the sections of the wall of centralizer that extend between the innermost points and the outermost points of centralizer. After the electronics package has been inserted, the electronics package may be anchored against longitudinal motion.

In some applications, as drilling progresses, the outer diameter of components of the drill string may change. For example, a well bore may be stepped such that the wellbore is larger in diameter near the surface than it is in its deeper portions. At different stages of drilling a single hole, it may be desirable to install the same electronics package in drill string sections having different dimensions. Centralizers as described herein may be made in different sizes to support an electronics package within bores of different sizes. Centralizers as described herein may be provided at a well site in a set comprising centralizers of a plurality of different sizes. The centralizers may be provided already inserted into drill string sections or not yet inserted into drill string sections.

Moving a downhole probe or other electronics package into a drill string section of a different size may be easily performed at a well site by removing the electronics package from one drill string section, changing a spider or other longitudinal holding device to a size appropriate for the new drill string section and inserting the electronics package into the centralizer in the new drill string section.

For example, a set comprising: spiders or other longitudinal holding devices of different sizes and centralizers of different sizes may be provided. The set may, by way of non-limiting example, comprise spiders and centralizers dimensioned for use with drill collars having bores of a plurality of different sizes. For example, the spiders and centralizers may be dimensioned to support a given probe in the bores of drill collars of any of a number of different standard sizes. The set of centralizers may, for example include centralizers sufficient to support a given probe in any of a defined plurality of differently-sized drill collars. For example, the set may comprise a selection of centralizers that facilitate supporting the probe in drill collars having outside diameters such as two or more of: 4¾ inches (12 cm), 6½ inches (17 cm), 8 inches (20 cm), 9½ inches (24 cm) and 11 inches (28 cm). The drill collars may have industry-standard sizes. The drill collars may collectively include drill collars of two, three or more different bore diameters. The centralizers may, by way of non-limiting example, be dimensioned in length to support probes having lengths in the range of 2 to 20 meters.

In some embodiments the set comprises, for each of a plurality of different sizes of drill string section, a plurality of different sections of centralizer that may be used together to support a downhole probe of a desired length. By way of non-limiting example, two 3 meter long sections of centralizer may be provided for each of a plurality of different bore sizes. The centralizers may be used to support 6 meters of a downhole probe.

Embodiments as described above may provide one or more of the following advantages. Centralizer 128 may extend for the full length of the electronics package 122 or any desired part of that length. Centralizer 128 positively prevents electronics package 122 from contacting the inside of bore 127 even under severe shock and vibration. The cross-sectional area occupied by centralizer 128 can be relatively small, thereby allowing a greater area for the flow of fluid past electronics package 122 than would be provided by some other centralizers that occupy greater cross-sectional areas. Centralizer 128 can dissipate energy from shocks and vibration into the fluid within bore 127. The geometry of centralizer 128 is self-correcting under certain displacements. For example, restriction of flow through one channel tends to cause forces directed so as to open the restricted channel. Especially where centralizer 128 has four or more inward lobes, electronics package 122 is mechanically coupled to section 126 in all directions, thereby reducing the possibility for localized bending of the electronics package 122 under severe shock and vibration. Reducing local bending of electronics package 122 can facilitate longevity of mechanical and electrical components and reduce the possibility of catastrophic failure of the housing of electronics assembly 122 or components internal to electronics package 122 due to fatigue. Centralizer 128 can accommodate deviations in the sizing of electronics package 122 and/or the bore 127 of section 126. Centralizer 128 can accommodate slick electronics packages 122 and can allow an electronics package 122 to be removable while downhole (since a centralizer 128 can be made so that it does not interfere with withdrawal of an electronics package 122 in a longitudinal direction). Centralizer 128 can counteract gravitational sag and maintain electronics package 122 central in bore 127 during directional drilling or other applications where bore 127 is horizontal or otherwise non-vertical.

Apparatus as described herein may be applied in a wide range of subsurface drilling applications. For example, the apparatus may be applied to support downhole electronics that provide telemetry in logging while drilling ('LWD') and/or measuring while drilling ('MWD') telemetry applications. The described apparatus is not limited to use in these contexts, however.

One example application of apparatus as described herein is directional drilling. In directional drilling the section of a drill string containing a downhole probe may be non-vertical. A centralizer as described herein can maintain the downhole probe centered in the drill string against gravitational sag, thereby maintaining sensors in the downhole probe true to the bore of the drill string.

A wide range of alternatives are possible. For example, it is not mandatory that section 126 be a single component. In some embodiments section 126 comprises a plurality of components that are assembled together into the drill string (e.g. a plurality of drill collars). Centralizer 128 is not necessarily entirely formed in one piece. In some embodiments, additional layers are added to the wall of centralizer 128 to enhance stiffness, resistance to abrasion or other mechanical properties. The wall thickness of centralizer 128 may be varied to adjust mechanical properties of centralizer 128. Apertures or holes may be formed in the wall of the centralizer to allow fluid flow or to provide for other components to pass through the wall of the centralizer.

In a preferred embodiment, centralizer 128 supports electronics package 122 continuously or substantially continuously over a longitudinally-extending section of electronics package 122. Centralizer 128 may, for example, comprise a tubular structure comprising resiliently deformable features which can be introduced into the bore of section 126 and can then flex to accommodate the insertion of electronics package 122 into bore 127 between the features of centralizer 128. Centralizer 128 is constructed to continuously exert a compressive force on the outside surface of electronics package 122 and to exert an outward force on the walls of bore 127, thereby mechanically coupling electronics package 122 to section 126.

Section 126 is very stiff and therefore the resonant frequency of electronics package 122 is further raised by the mechanical coupling of electronics package 122 to section 126.

In some embodiments of downhole assembly 125, electronics package 122 comprises probe 31. This mechanically coupled structure, by virtue of its increased stiffness, has a higher resonant frequency than any of its component parts. A structure with a higher resonant frequency may be less susceptible to damage from low frequency vibrations which may accompany drilling operations. In some embodiments, all fundamental vibrational modes of probe 31 have frequencies well in excess of 10 Hz or 15 Hz.

Furthermore, this mechanically coupled structure acts to maintain the concentricity of electronics unit 31B of probe 31 within section 126. This can be advantageous in some circumstances. For example, when electronics unit 31B comprises a directional sensor, movement of electronics unit 31B within section 126 can introduce an offset to the measurements of the directional sensor.

Figure 7:
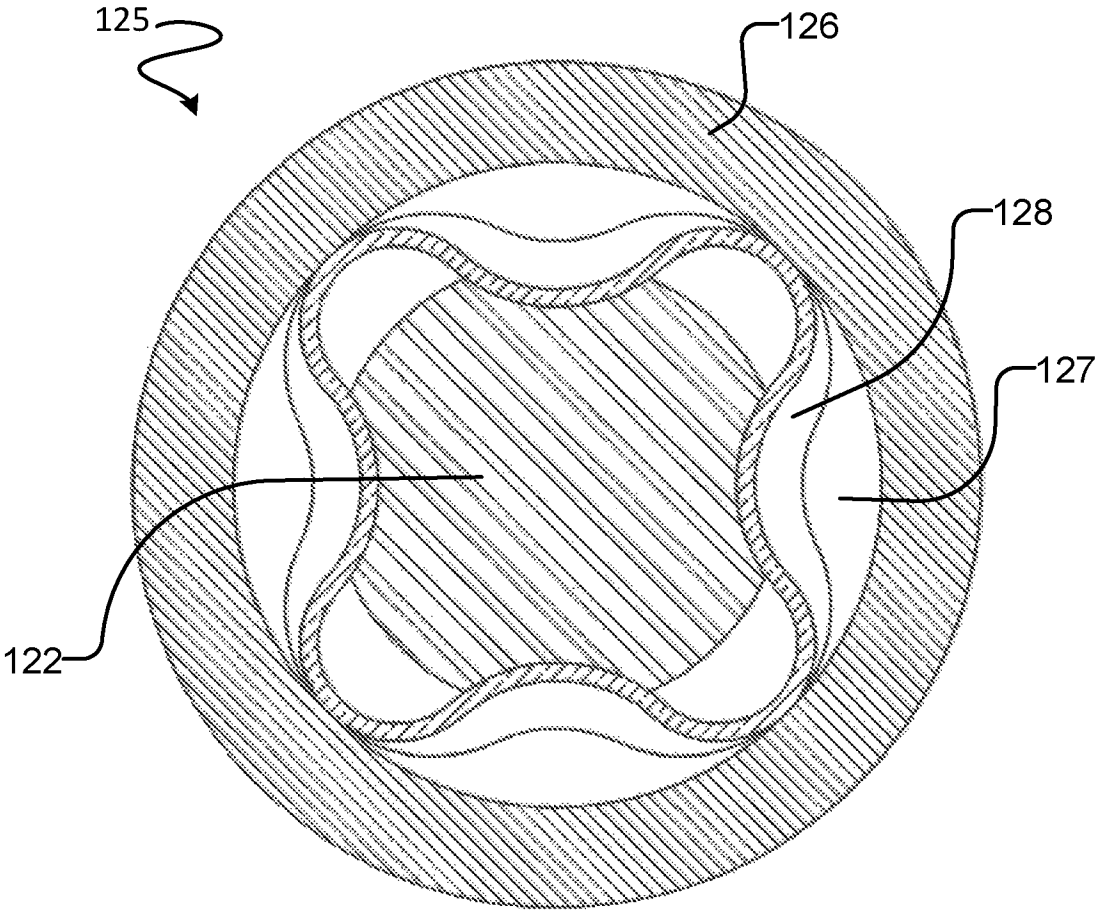
FIG. 7 is a view of the same structure in FIG. 4A, but with the electronics package only partially inserted.

FIG. 7 illustrates electronics package 122 partially inserted into centralizer 128 located within bore 127 of section 126. This Figure shows how the passage of electronics package 122 can force inwardly-directed parts of centralizer 128 outward such that electronics package 122 is tightly coupled to the inner wall of section 126 by centralizer 128.

In some embodiments of the invention, a gaseous drilling fluid is used, for example, air. In some embodiments, a drilling fluid comprising a liquid and a gas may be used, for example 10-15% liquid and 80-85% gas. The flow rate of a gaseous drilling fluid may range from, for example, 1,500 standard cubic feet per minute (SCF/min) to 13,000 SCF/min (42475 l/min to 368119 l/min). In other embodiments, other flow rates may be used.

A gaseous drilling fluid generally provides much less damping of vibrations of the probe than a liquid drilling fluid. For example, a probe being used in conjunction with a gaseous drilling fluid may experience g forces due to shocks having magnitudes several times higher than would be the case if the probe were surrounded by a liquid drilling fluid.

Since centralizer 128 may cooperate with drilling fluid within bore 127 to damp undesired motions of electronics package 122, centralizer 128 may be designed with reference to the type of fluid that will be used in drilling. For a gaseous drilling fluid, centralizer 128 may be made with thicker walls and/or made of a stiffer material so that it can hold electronics package 122 against motions in the absence of an incompressible liquid drilling fluid. Conversely, the presence of liquid drilling fluid in channels 134 and 136 tends to dampen high-frequency vibrations and to cushion transverse motions of electronics package 122. Consequently, a centralizer 128 for use with liquid drilling fluids may have thinner walls than a centralizer 128 designed for use with gaseous drilling fluids.

When a gaseous drilling fluid is used the benefits of the methods and apparatus disclosed herein may be especially significant because without the dampening effects of a liquid drilling fluid, probes are even more susceptible to damage vibrations.

Interpretation of Terms

Unless the context clearly requires otherwise, throughout the description and the claims:

"comprise," "comprising," and the like are to be construed in an inclusive sense, as opposed to an exclusive or exhaustive sense; that is to say, in the sense of "including, but not limited to".

"connected," "coupled," or any variant thereof, means any connection or coupling, either direct or indirect, between two or more elements; the coupling or connection between the elements can be physical, logical, or a combination thereof.

"herein," "above," "below," and words of similar import, when used to describe this specification shall refer to this specification as a whole and not to any particular portions of this specification.

"or," in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, drill string component, drill rig system, etc.) is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of systems, methods and apparatus have been described herein for purposes of illustration. These are only examples. The technology provided herein can be applied to systems other than the example systems described above. Many alterations, modifications, additions, omissions and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

It is therefore intended that the following appended claims and claims hereafter introduced are interpreted to include all such modifications, permutations, additions, omissions and sub-combinations as may reasonably be inferred. The scope of the claims should not be limited by the preferred embodiments set forth in the examples, but should be given the broadest interpretation consistent with the description as a whole.

What is claimed is:

1. A drilling apparatus comprising:

a probe located within a bore of a drill collar coupled into a drill string, the drill string comprising a plurality of sections above the drill collar, the bore of the drill collar having a first diameter and the drill string sections having bores of a second diameter smaller than the first diameter; and a centralizer slidably removable from the bore of the drill collar, an outside of the centralizer having a third diameter larger than the second diameter, wherein the probe is inside the centralizer and the centralizer is in the bore of the drill collar, the centralizer dividing a space surrounding the probe into at least one inner channel defined between the centralizer and the probe and at least one outer channel defined between the centralizer and an inner wall of the drill collar, the inner and outer channels separated by the centralizer, wherein the inner and outer channels and the bores of the drill string sections are in fluid communication thereby permitting drilling fluid to flow through the drill string past the probe to a drill bit.

2. A drilling apparatus according to claim 1 comprising a drilling fluid pump operable to pump drilling fluid through the drill string to the drill bit wherein the drilling apparatus is operable to drill a wellbore while the drilling fluid in the drill collar maintains a flow velocity of less than 41 feet per second (about 12.5 m/s).

3. A drilling apparatus according to claim 2 wherein the drill collar comprises a wall that is thinner than walls of the drill string sections.

4. A drilling apparatus according to claim 3 wherein an outer diameter of the drill collar is the same as the outer diameter of the drill string sections.

5. A drilling apparatus according to claim 3 wherein the drill collar comprises a yield strength exceeding 130,000 psi (9,140 kgf/cm$^2$).

6. A drilling apparatus according to claim 5 wherein the wall of the drill collar comprises a non-magnetic stainless steel alloy.

7. A drilling apparatus according to claim 3 wherein a ratio of the diameter of the bore of the drill collar to an outer diameter of the drill collar is in the range of 0.675 to 0.76.

8. A drilling apparatus according to claim 3 wherein at least one cross-section of the probe has an area of at least pi inches squared (about 20 cm$^2$).

9. A drilling apparatus according to claim 8 wherein the probe is cylindrical.

10. A drilling apparatus according to claim 9 wherein the probe has a diameter of at least 2.54 inches (about 6.5 cm).

11. A drilling apparatus according to claim 1 wherein the probe comprises an electronics unit and a housing, wherein at least a portion of the electronics unit forms a size-on-size fit with the housing.

12. A drilling apparatus according to claim 11 wherein the electronics unit is shaped like a cylinder and the housing is shaped like a hollow cylinder.

13. A drilling apparatus according to claim 11 wherein an entire longitudinal surface of the electronics unit is dimensioned to form a size-on-size fit with the housing.

14. A drilling apparatus according to claim 11 wherein the housing has a length to outer diameter ratio of less than 70:1.

15. A drilling apparatus according to claim 11 wherein the housing is less than 20 feet (about 6.1 m) long.

16. A drilling apparatus according to claim 1 wherein the centralizer comprises a tubular member having a wall extending around the probe, the wall formed to contact an internal wall of the drill collar and an outside surface of the probe, a cross-section of the wall following a path around the probe that zig zags back and forth between the outside surface of the probe and the internal wall of the drill collar.

17. A drilling apparatus according to claim 1 wherein outside diameter and bore diameter of the sections of the drill string are according to an API standard, the outside diameter of the drill collar corresponds to the API standard and the diameter of the bore of the drill collar is larger than specified by the API standard.

18. A drilling apparatus according to claim 1 wherein:

the drill string sections have outer diameters of 4 ¾inches and a cross sectional area of the fluid flow path in the bore of the drill collar around the probe is at least 2¾in$^2$ (17.7 cm$^2$); or the drill string sections have outer diameters of 6 ½inches and a cross sectional area of the fluid flow path in the bore of the drill collar around the probe is at least 5.3 in$^2$ (34.1 cm$^2$); or the drill string sections have outer diameters of 8 inches and a cross sectional area of the fluid flow path in the bore of the drill collar around the probe is at least 10.6 in$^2$ (68.2 cm$^2$).

19. A drilling apparatus according to claim 1 wherein the probe has no resonant modes having frequencies of less than 15 Hertz.

20. A method for subsurface drilling, the method comprising:

providing a drill collar having a bore of a first diameter, and a centralizer, an outside of the centralizer having a third diameter;

assembling a probe into the drill collar by steps comprising inserting the probe into the centralizer and sliding the centralizer into the bore of the drill collar, the centralizer dividing a space surrounding the probe into at least one inner channel defined between the centralizer and the probe and at least one outer channel defined between the centralizer and an inner wall of the drill collar, the inner and outer channels separated by the centralizer;

connecting the drill collar to a drill string comprising a plurality of sections above the drill collar, the sections having bores of a second diameter less than the first diameter and less than the third diameter; and while drilling, passing a drilling fluid through the bores of the sections and the bore of the drill collar while maintaining a flow velocity of the drilling fluid less than 41 feet per second (about 12.5 m/s) in the bore of the drill collar.

21. A method according to claim 20 wherein the drill collar comprises a wall that is thinner than walls of the drill string sections.

22. A method according to claim 21 wherein the outer diameter of the drill collar is the same as the outer diameter of the drill string sections.

23. A method according to claim 21 wherein a ratio of the diameter of the bore of the drill collar to an outer diameter of the drill collar is in the range of 0.675 to 0.76.

24. A method according to claim 21 wherein the drill collar comprises a yield strength of at least 130,000 psi (9,140 kgf/cm$^2$).

25. A method according to claim 24 wherein the drill collar comprises a non-magnetic stainless steel alloy.

26. A method according to claim 21 wherein at least one cross-section of the probe has an area of at least pi inches squared (about 20 cm$^2$).

27. A method according to claim 20 wherein providing the probe comprises:

providing an electronics unit and a housing; and inserting the electronics unit into the housing;

wherein at least a portion of the electronics unit forms a size-on-size fit with the housing.

28. A method according to claim 27 wherein the electronics unit is shaped like a cylinder and the housing is shaped like a hollow cylinder.

29. A method according to claim 27 wherein an entire longitudinal surface of the electronics unit is dimensioned to form a size-on-size fit with the housing that prevents the electronics unit from moving laterally relative to the housing.

30. A method according to claim 27 comprising providing a thin material between an exterior lateral wall of the electronics unit and an interior lateral wall of the housing.

31. A method according to claim 27 wherein the housing has a length to outer diameter ratio of less than 70:1.

32. A method according to claim 27 wherein the housing is less than 20 feet long (about 6.1 m).

33. A method according to claim 27 comprising mechanically coupling the housing to the drill collar.

34. A method according to claim 20 wherein the centralizer comprises a tubular member having a wall extending around the probe, the wall formed to contact an internal wall of the drill collar and an outside surface of the probe, a cross-section of the wall following a path around the probe that zig zags back and forth between the outside surface of the probe and the internal wall of the drill collar.

* * * * *